US007473210B1

(12) United States Patent
Hsiung

(10) Patent No.: US 7,473,210 B1
(45) Date of Patent: Jan. 6, 2009

(54) APPARATUS TO ENABLE A USER TO SIMULATE SKATING

(75) Inventor: Bob Hsiung, Walnut, CA (US)

(73) Assignee: Hupa International, Inc., Walnut, CA (US)

( * ) Notice: Subject to any disclaimer, the term of this patent is extended or adjusted under 35 U.S.C. 154(b) by 0 days.

(21) Appl. No.: 12/002,393

(22) Filed: Dec. 17, 2007

Related U.S. Application Data

(63) Continuation-in-part of application No. 11/082,279, filed on Mar. 16, 2005, now Pat. No. 7,338,414.

(51) Int. Cl.
*A63B 21/00* (2006.01)

(52) U.S. Cl. ..... 482/51; 482/52

(58) Field of Classification Search ..... 482/51, 482/52, 71, 79, 110, 116; 434/247, 253
See application file for complete search history.

(56) References Cited

U.S. PATENT DOCUMENTS 5,013,031 A * 5/1991 Bull ..... 482/52
7,115,073 B2 * 10/2006 Nizamuddin ..... 482/51
7,115,075 B2 * 10/2006 Johnston ..... 482/51

* cited by examiner

*Primary Examiner*—Jerome Donnelly
(74) *Attorney, Agent, or Firm*—Thomas I. Rozsa

(57) ABSTRACT

An improved skating machine, wherein the improvement involves the incorporation of flexible components including (1) identical first and second pedal connector flexible bars rotatably connected at one respective one to a respective first and second longitudinal pedal bar and rotatably connected at their respective opposite end to a crank axle; (2) a resilient tension means connected at one end to the crank axle and connected at its opposite end to a post which is attached to a portion of a central longitudinal base frame; and (3) at least one transverse interconnecting elastic means transversely interconnecting the first and second longitudinal pedal bars. The flexible components have sufficient elasticity to prevent the machine from locking when the crank and the pedal connector bars are aligned with each other when the pedals are at their extreme left or right position.

28 Claims, 24 Drawing Sheets

APPARATUS TO ENABLE A USER TO SIMULATE SKATING

The present application is a continuation-in-part of a patent application Ser. No. 11/082,279 filed on Mar. 16, 2005 now U.S. Pat. No. 7,338,414.

BACKGROUND OF THE INVENTION

1. Field of the Invention

The present invention relates to exercise apparatus, and more particularly to a specific type of exercise apparatus which enables a user to simulate skating.

2. Description of the Prior Art

In general, apparatus which enables a user to simulate skating, known as a skating machine, has been known in the prior art. However, prior art skating machines suffer from one critical design defect. In prior art skating machines, the apparatus by which the skating foot pedal moves side to side is a double crank apparatus which is not restrained in any manner in the longitudinal direction. As a result, the double crank can be rotated to a point where the two cranks are at 180 degrees to each other which creates a "dead" angle so that the two cranks lock in place and the skating machine is "frozen". There is a significant need for an improved design for a skating machine which eliminates the "dead" angle and eliminates the skating machine being "frozen" during its operation so that the improved skating machine can provide a smooth movement to users.

SUMMARY OF THE INVENTION

The present invention is an improved apparatus to enable a user to simulate skating, hereafter referred to as a skating machine, wherein the improvement involves the incorporation of a tension means connected at one end to the location of the intersection of a pedal connector bar and a crank to prevent the skating machine from locking or freezing when the pedals are at their most sideways positions. The crank is connected at its opposite end to a resistance means and the pedal connector bar is connected at its opposite end to a portion of a pedal assembly. The tension means is connected at its opposite end to a location on the skating machine frame. The crank and pedal connector bar are aligned in an almost horizontal 180 degree position when the pedal are at their extreme left or right position and the tension means prevents the machine from locking in this position.

The present invention is also an improved apparatus to enable a user to simulate skating, hereafter referred to as a skating machine which is comprised of basic structural parts including a front and rear transverse base frame respectively connected to a central longitudinal base frame, and a first and second longitudinal pedal bar rotatably connected to the respective right and left end of the front transverse base frame, wherein the improvement involves the incorporation of flexible parts including (1) an identical first and second pedal connector flexible bar rotatably connected at a respective one end of each bar to the respective first and second longitudinal pedal bar and rotatably connected at the respective opposite end of the each bar to a crank axle; (2) a resilient tension means connected at one end to the crank axle and connected at its opposite end to a post which is attached to a portion of the central longitudinal base frame; and (3) at least one transverse interconnecting elastic means transversely interconnecting the first and second longitudinal pedal bar.

With the aid of all the flexible parts, during operation, the flexible parts prevents the skating machine from locking or freezing at two positions, where the pedals are at their extreme left or right position so that the crank and pedal connector flexible bars are aligned with each other which causes locking and freezing of the circular motion of the upper part of the machine.

It has been discovered, according to the present invention, that the crank and pedal connector bar of a skating machine lock when the pedals of the skating machine are at the most extreme left or right position and the incorporation of a source of tension at the intersection of the crank and pedal connector bar will prevent locking and result in a smooth skating action.

It has also been discovered, according to the present invention, that incorporation of an identical first and second pedal connector flexible bar to replace the respective traditional rigid bar, wherein the identical first and second pedal connector flexible bars are rotatably connected at a respective one end of the each bar to the respective first and second longitudinal pedal bar and rotatably connected at the respective opposite end of each bar to a crank axle, will significantly prevent locking of the circular motion of the machine and result a smooth skating action.

It has further been discovered, according to the present invention, that incorporation of an identical first and second pedal connector flexible bar to replace the respective traditional rigid bar, in addition to application of at least one transverse interconnecting elastic means to replace the respective traditional inextensible cable which transversely interconnects the first and second longitudinal pedal bars, will more significantly prevent locking of the circular motion of the machine and result in a smooth skating action.

It has been additionally discovered, according to the present invention, that incorporation of an identical first and second pedal connector flexible bar to replace the respective traditional pedal connector rigid bar, at least one transverse interconnecting elastic means to replace the traditional inextensible cables, and a tension means connected at one end to the location of the intersection of the pedal connector flexible bars and the crank and at the opposite end to a portion of the longitudinal base frame will most significantly prevent locking of the circular motion of the machine and result in a smooth skating action.

It is therefore an object of the present invention to provide a skating machine which will not lock and will provide a smooth skating action from extreme left to extreme right.

It is also an object of the present invention to provide a skating machine which will not lock and will provide a mostly smooth skating action through the addition of flexible structural parts including an identical first and second pedal connector flex bar, a resilient tension means and at least one transverse interconnecting elastic means.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
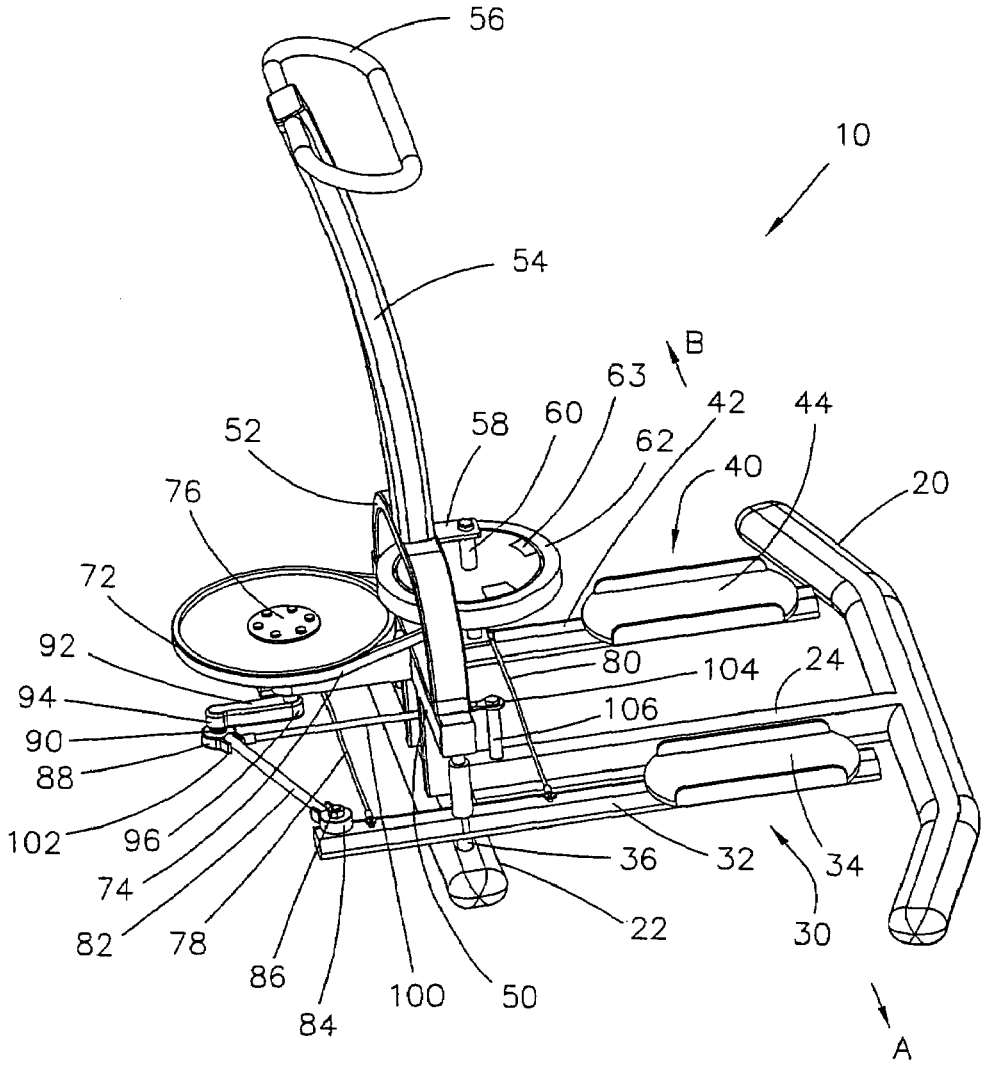
FIG. 1 is a perspective view of the preferred embodiment of the present invention skating machine.
Figure 2:
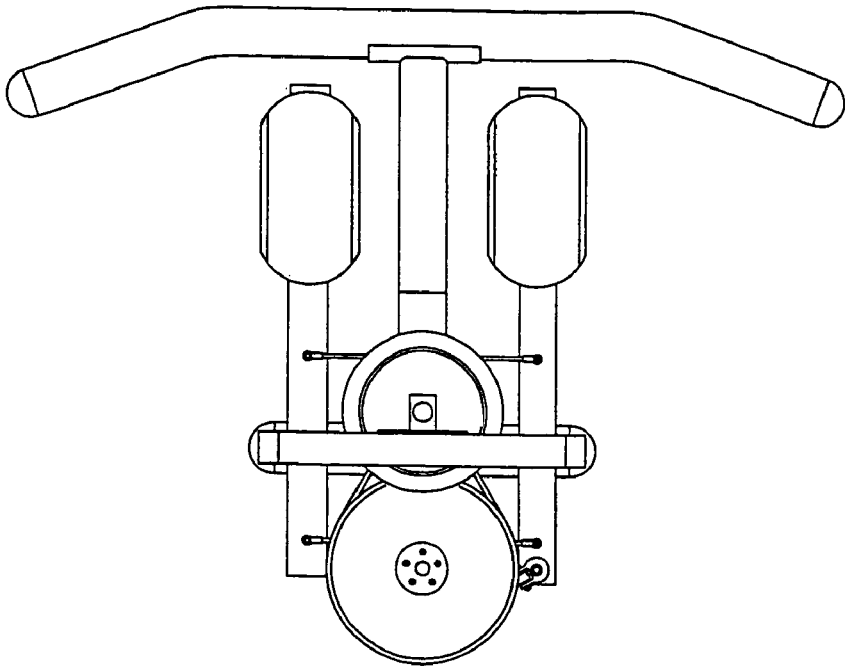
FIG. 2 is a plan view of the skating machine illustrated in FIG. 1 with the handle bar assembly removed.
Figure 3:
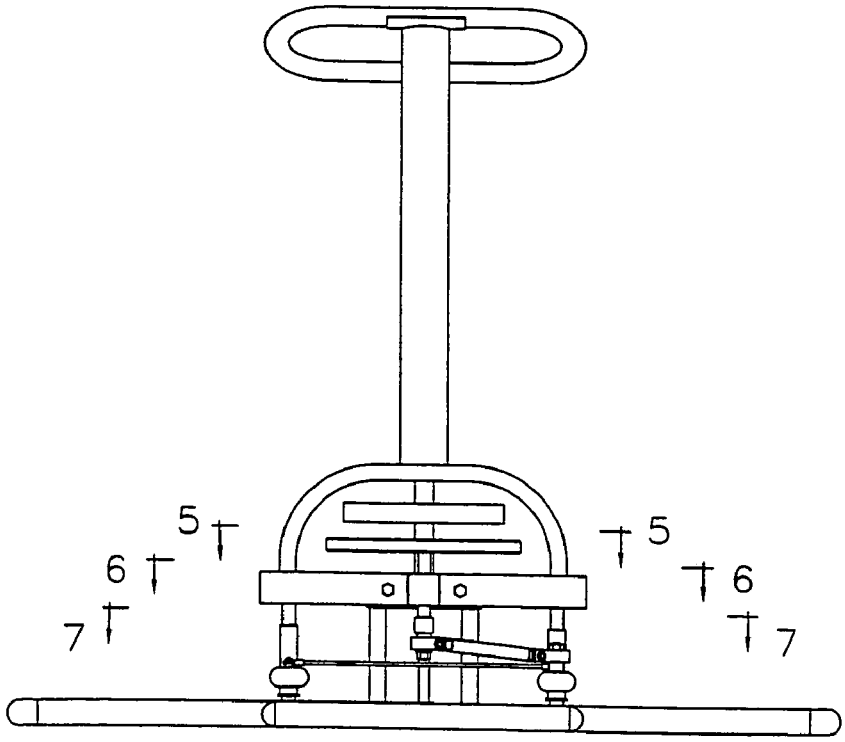
FIG. 3 is a front elevational view of the embodiment of the skating machine illustrated in FIG. 1.
Figure 4:
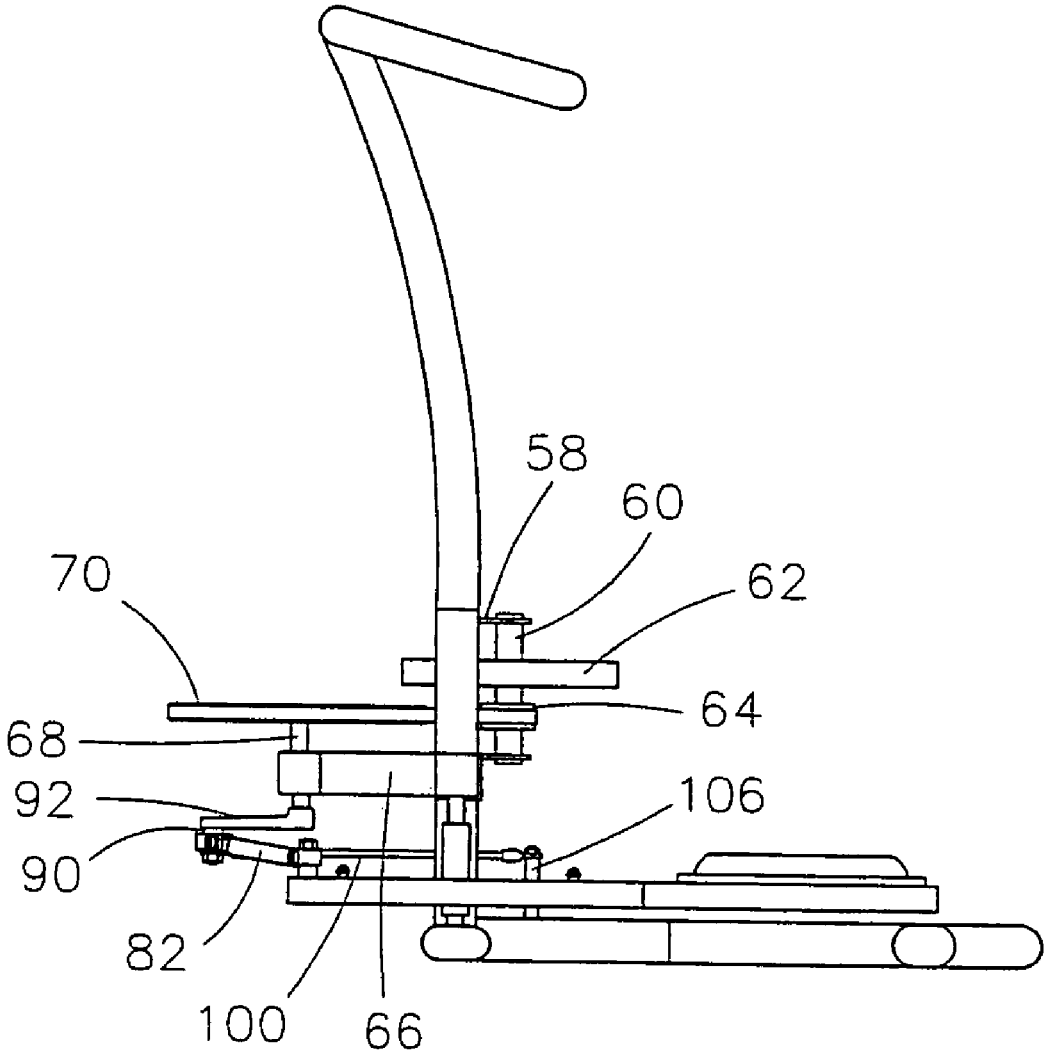
FIG. 4 is a side elevational view of the embodiment of the skating machine illustrated in FIG. 1.
Figure 5:
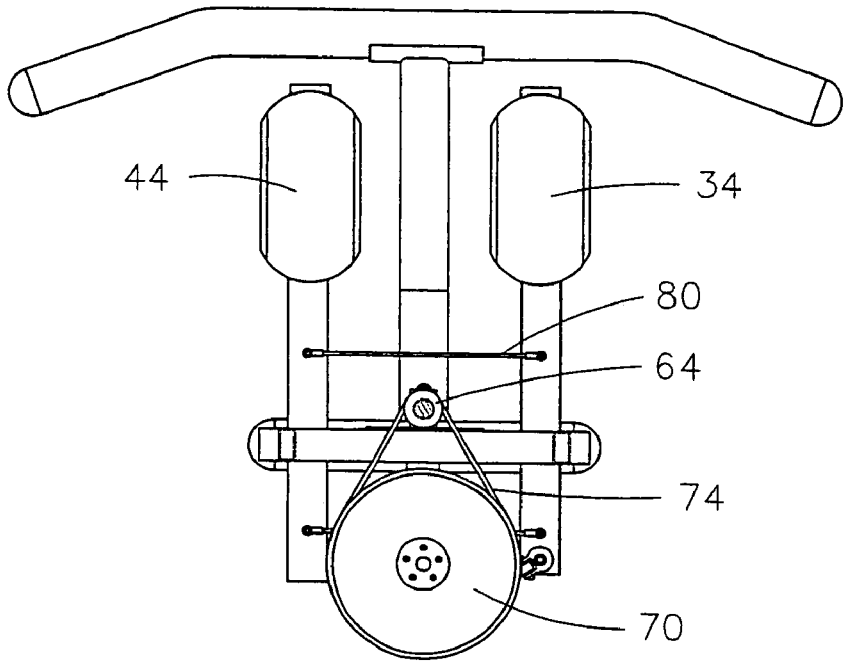
FIG. 5 is a cross-sectional view of the skating machine as it would be seen along Line 5-5 of FIG. 3.
Figure 6:
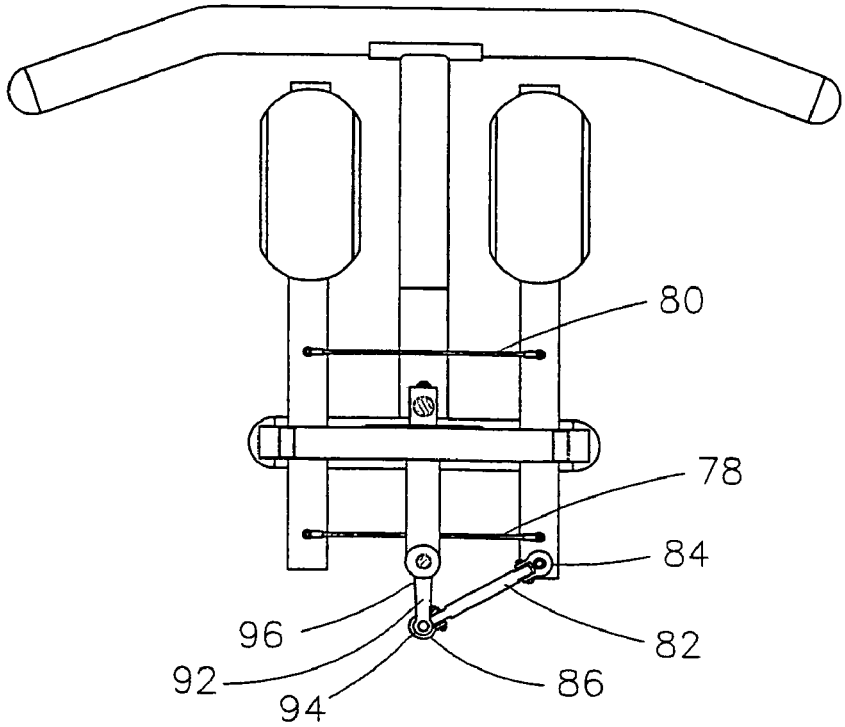
FIG. 6 is a cross-sectional view of the skating machine as it would be seen along Line 6-6 of FIG. 3.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 13, there is illustrated the preferred embodiment of the present invention apparatus to enable a user to simulate skating which will hereinafter be referred to as a skating machine 10. The skating machine 10 is supported on a rear transverse frame 20, and a front transverse frame 22 which are interconnected by a longitudinal frame 24. The skating machine 10 further comprises a first pedal assembly 30 having a first longitudinal pedal bar 32 to which a first foot pedal 34 is connected. The first longitudinal pedal bar 32 is rotatably connected to the front transverse frame 22 by a first rod 36. The skating machine 10 further comprises a second pedal assembly 40 having a second longitudinal pedal bar 42 to which a second foot pedal 44 is connected. The second longitudinal pedal bar 42 is rotatably connected to the front transverse frame 22 by a second rod 46.

First and second foot pedal assemblies 30 and 40 are spaced apart and side-by-side to each other and located along opposite sides of longitudinal frame 24. Rods 36 and 46 are also connected to an upper transverse frame 50 which supports a semicircular frame 52 to which is connected a handle post 54 which supports a handlebar 56. A pair of identical upper and lower rearward and longitudinal bars 58 is respectively located, wherein the upper one is positioned on the semicircular frame 52 and the lower one is positioned on the upper transverse frame 50. The paired bars 58 through a connecting rod of flywheel axle 60 rotatably support a flywheel 62. The flywheel 62 is connected to a collar or pulley 64 so that the collar or pulley 64 will rotate with the flywheel 62.

A forward bar 66 is supported on transverse frame 50 and through a connecting rod or pulley axle 68 rotatably supports a pulley wheel 70 which has a circumferential channel 72 into which is supported a connecting band 74. The connecting band 74 also is connected to collar or pulley 64, and as the pulley wheel 70 rotates, the flywheel 62 also rotates. The pulley wheel 70 is connected to the connecting rod 68 by mounting bracket 76. The purpose of the flywheel 62 is to add resistance to the rotation of the pulley wheel 70. By way of example only, the flywheel 62 can be a weighted magnetic flywheel having a multiplicity of magnets 63.

The new innovative features of the present invention skating machine 10 will now be described. The first and second longitudinal pedal bars 32 and 42 are interconnected adjacent their front ends by a first flexible cable 78 located in front of front transverse frame 22 and by a second flexible and inextensible cable 80 located adjacent a portion of the longitudinal pedal bars 32 and 42 positioned behind front transverse frame 22.

An elongated pedal connector bar 82 is rotatably connected at its first end 84 to the front of the first longitudinal pedal bar 32 by rod means 86 and is rotatably connected at its second end 88 to crank axle 90. A crank 92 is connected at its first end 94 to the crank axle 90 and connected at its second end 96 to the connecting rod or pulley axle 68 to which the pulley wheel 70 is also connected. A key innovation of the present invention skating machine 10 is the addition of a resilient tension means 100 which by way of example can be a bungee cord. The resilient tension means 100 is connected at one end 102 to the crank axle 90 and is connected at its opposite end 104 to a post 106 which is connected at its opposite end to longitudinal frame 24. The preferred embodiment as illustrated in FIGS. 1 to 13 has the post 106 connected to the longitudinal frame 24 at a location behind front transverse frame 22. It is also within the spirit and scope of the present invention to have the post 106 connected at other locations on the skating machine—by way of example, to the front transverse frame 22. The addition of the stretchable tension means or bungee cord 100 is a key innovation because it prevents the pedal connector bar 82 and crank 92 from locking at a "dead" angle when they are aligned to thereby prevent the skating machine 10 from being "frozen". The stretchable tension means 100 permits a continuous fluid motion as the user skates side to side on the skating machine 10.

Figure 9:
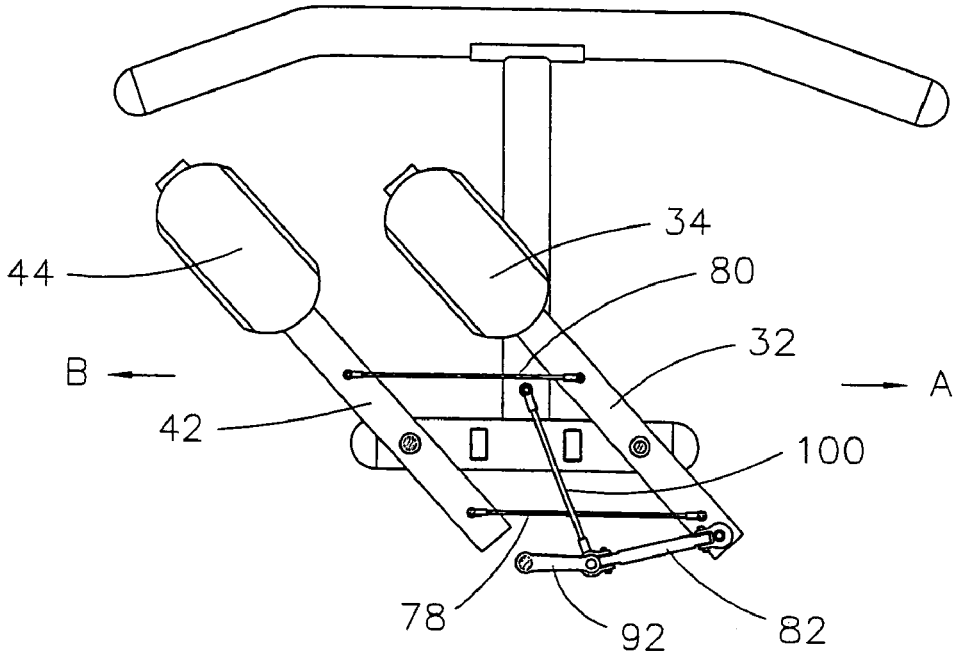
FIG. 9 is a cross-sectional view of the skating machine as it would be seen along Line 7-7 of FIG. 3 with the crank rotated 90 degrees counterclockwise.
Figure 12:
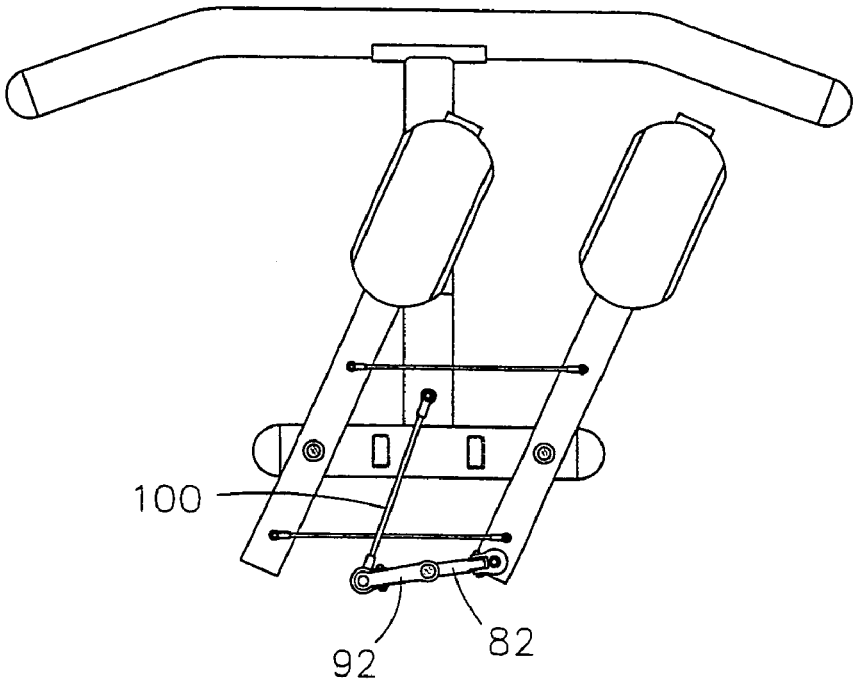
FIG. 12 is a cross-sectional view of the skating machine as it would be seen along Line 7-7 of FIG. 3 with the crank rotated to a position where its long axis is collinear with the connecting rod.
Figure 13:
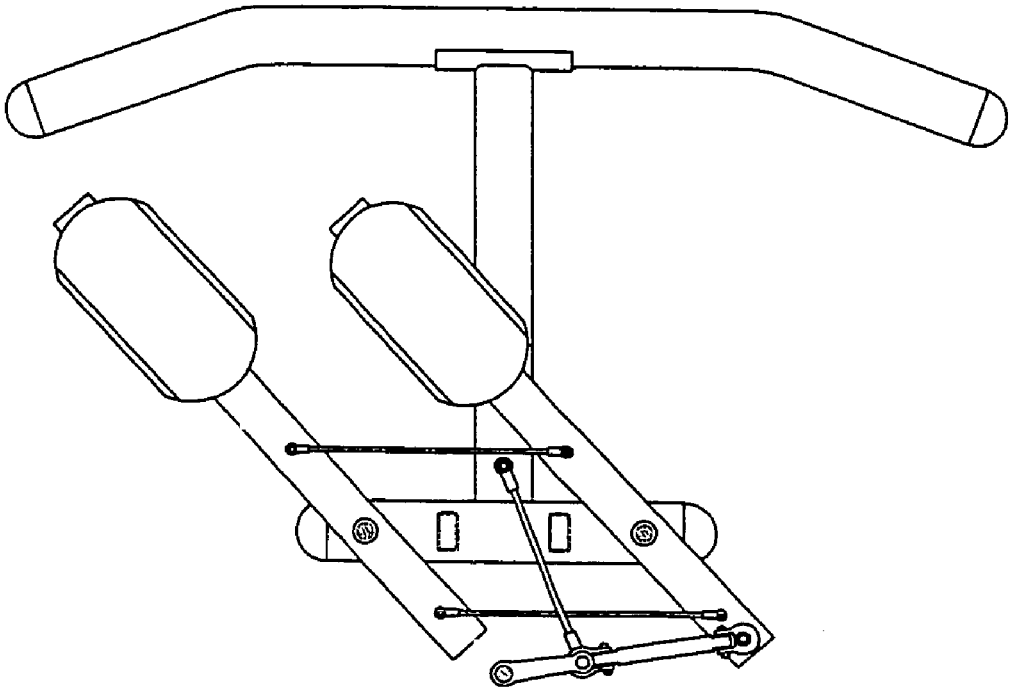
FIG. 13 is a cross-sectional view of the skating machine as it would be seen along Line 7-7 of FIG. 3 with the crank rotated 180 degrees from its positioning in FIG. 12 to a second position where the long axis of the crank is collinear with the connecting rod.

The operation of the skating machine 10 will now be described. A user stands on the skating machine 10 so that the user's left foot rests in first foot pedal 34 and the user's right foot rests in second foot pedal 44. The user holds onto handlebar 56. The user causes the pedals to move sideways to the left in the direction of arrow A and then back in the other sideways direction or to the right in the direction of arrow B. Referring to FIG. 9, the user has caused the first pedal assembly 30 and second pedal assembly 40 to be rotated to the right in the direction of arrow B. The crank 92 is rotated 90 degrees counterclockwise from its position in FIG. 7. Referring to FIG. 12, the user has caused the pedal assemblies to be rotated to the left to a position where crank 92 is aligned with bar 82. Resilient tension means or bungee cord 100 prevents the crank 92 and pedal connector bar 82 from locking or freezing at this position. FIG. 13 shows the user having caused the pedal assemblies to have moved to the right so that the crank 92 and pedal connector bar 82 are once again aligned and once again the resilient tension means or bungee cord 100 prevents the crank 92 and pedal connector bar 82 from locking or freezing at this position. The flexible and inextensible cables 78 and 80 assure that first longitudinal pedal bar 32 and second longitudinal bar 42 move together in synchronization.

It will also be appreciated that while two flexible and inextensible cables 78 and 80 were illustrated in the preferred embodiment, it is also within the spirit and scope of the present invention to have at least one flexible and inextensible cables either 78 or 80, and positioned anywhere along the lengths of longitudinal pedal bars 32 and 42.

Figure 7:
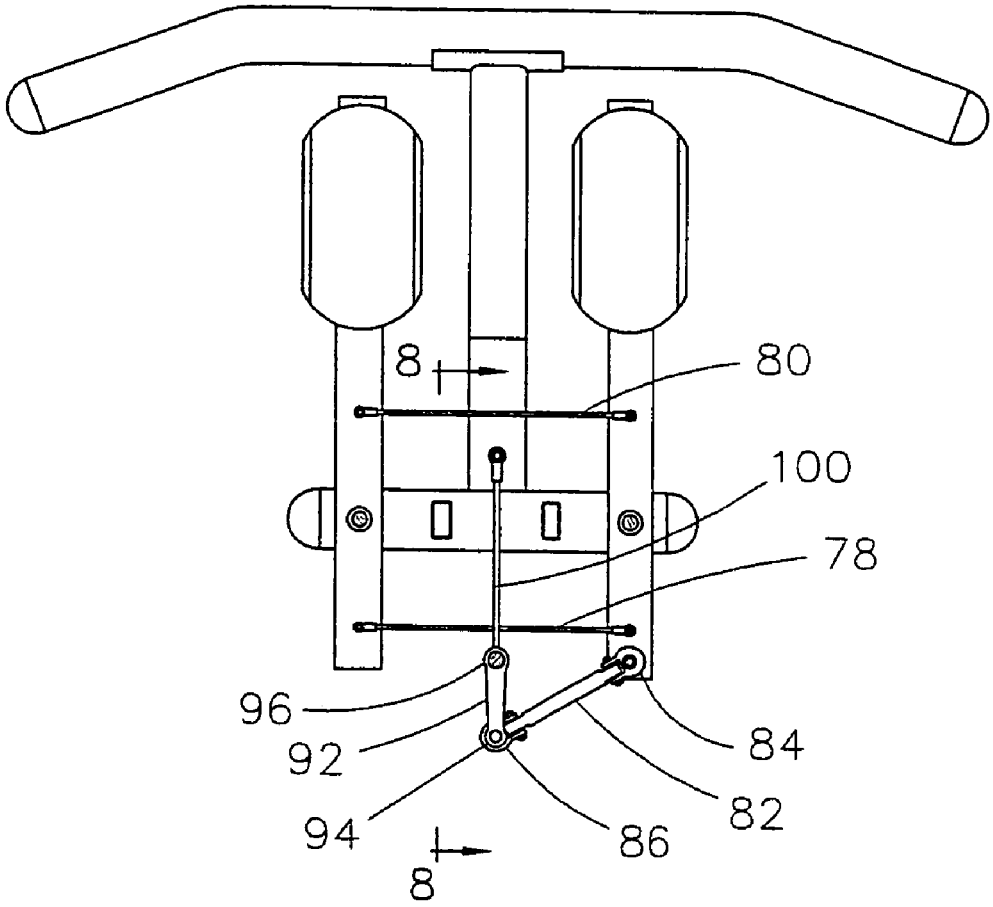
FIG. 7 is a cross-sectional view of the skating machine as it would be seen along Line 7-7 of FIG. 3.
Figure 8:
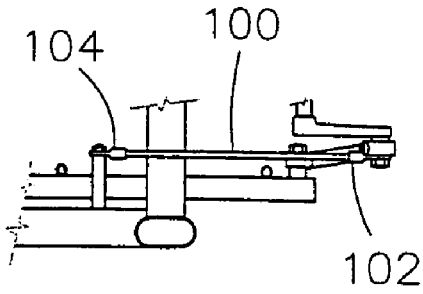
FIG. 8 is a cross-sectional view (rotated 90 degrees counterclockwise) of the skating machine as it would be seen along Line 8-8 of FIG. 7.
Figure 10:
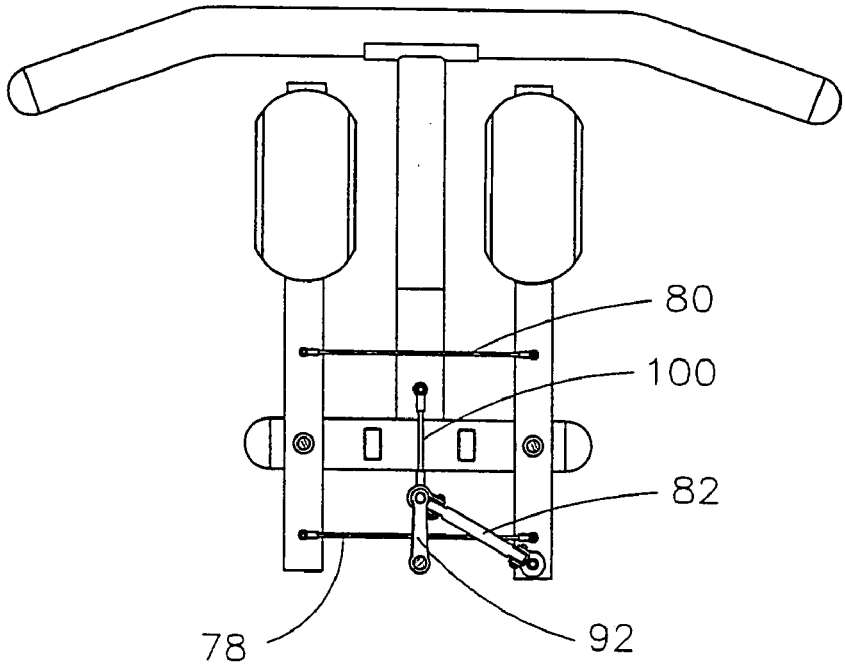
FIG. 10 is a cross-sectional view of the skating machine as it would be seen along Line 7-7 of FIG. 3 with the crank rotated 180 degrees counterclockwise.
Figure 11:
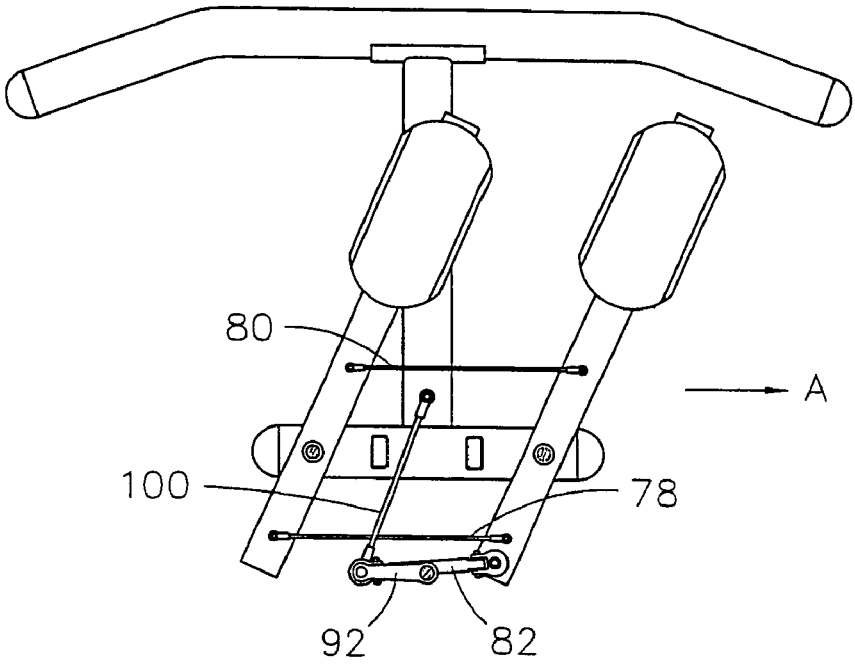
FIG. 11 is a cross-sectional view of the skating machine as it would be seen along Line 7-7 of FIG. 3 with the crank rotated 270 degrees counterclockwise.

Referring to FIG. 10, the user has now skated to the left so that the pedal assemblies 30 and 40 are in their standing position with crank 92 rotated 90 degrees clockwise from its position in FIG. 9 or 180 degrees counterclockwise from its position in FIG. 7. FIG. 11 shows the user having caused the pedal assemblies to have moved to the left with the crank 92 rotated 90 degrees clockwise from its position in FIG. 10. Referring to FIG. 12, the user has caused the pedal assemblies to be rotated to the left to a position where crank 92 is aligned with bar 82. Resilient tension means or bungee cord 100 prevents the crank 92 and pedal connector bar 82 from locking or freezing at this position. FIG. 13 shows the user having caused the pedal assemblies to have moved to the right so that the crank 92 and pedal connector bar 82 are once again aligned and once again the resilient tension means or bungee cord 100 prevents the crank 92 and pedal connector bar 82 from locking or freezing at this position. The flexible and inextensible cables 78 and 80 assure that first longitudinal pedal bar 32 and second longitudinal bar 42 move together in synchronization. It can be seen from FIGS. 12 through 13 that the crank 92 and pedal connector bar 82 are aligned when the pedal assemblies 30 and 40 have been rotated to their outermost left and right positions. The problem with prior art skating machines is that it is in this position that the skating machine "locks" or "freezes". The addition of the flexible resilient tension means 100 prevents the "locking" or "freezing" from occurring.

As the side to side motion is taking place, the pulley wheel 70 is rotating and resistance is provided by the interconnected flywheel 62 which is also rotating due to the interconnecting band 74 connecting the pulley wheel 70 to the pulley 64 of the flywheel 62. A resistance variation means connected to the flywheel 62 permits the user to increase or decrease the amount of resistance created by the flywheel 62.

Figure 14:
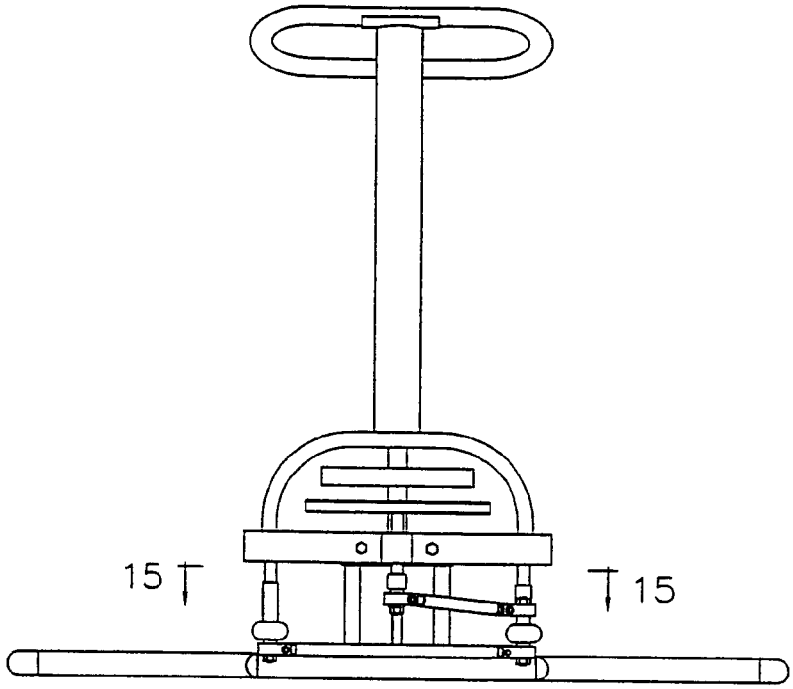
FIG. 14 is a front elevational view of an alternative embodiment of the skating machine.
Figure 15:
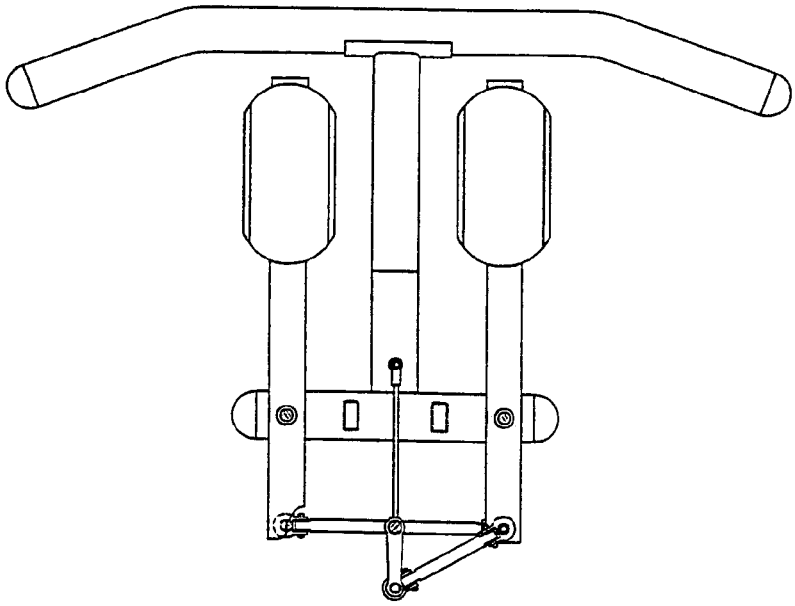
FIG. 15 is a cross-sectional view of the skating machine as it would be seen along Line 15-15 of FIG. 14.

An alternative embodiment of the skating machine 10A is illustrated in FIGS. 14 and 15. The only difference in the alternative embodiment illustrated in FIGS. 14 and 15 is a change in the pedal assembly transverse interconnecting means. In the preferred embodiment, the pedal assembly transverse interconnecting means were the pair of flexible and inextensible cables 78 and 80. In the alternative embodiment the flexible and inextensible cables 78 and 80 have been replaced with a transverse rod 120 rotatably affixed adjacent to the respective front ends of first longitudinal pedal bar 32 and second longitudinal pedal bar 42.

Through use of the present invention, an improved skating machine is provided with a smooth side to side skating action which will not lock or freeze at the extreme left or right sideways position. While the skating machine 10 has been illustrated with a maximum side to side angle of approximately 45 degrees, it will be appreciated that the angle can be increased to any larger desired angle by increasing the length of pedal connector bar 82. The angle can be decreased by decreasing the length of pedal connector bar 82. It will also be appreciated that the opposite end of the tension means 100 remote from the intersection of the crank 92 and the pedal connector bar 82 can be attached at any desired location on a portion of the frame of the skating machine.

Figure 16:
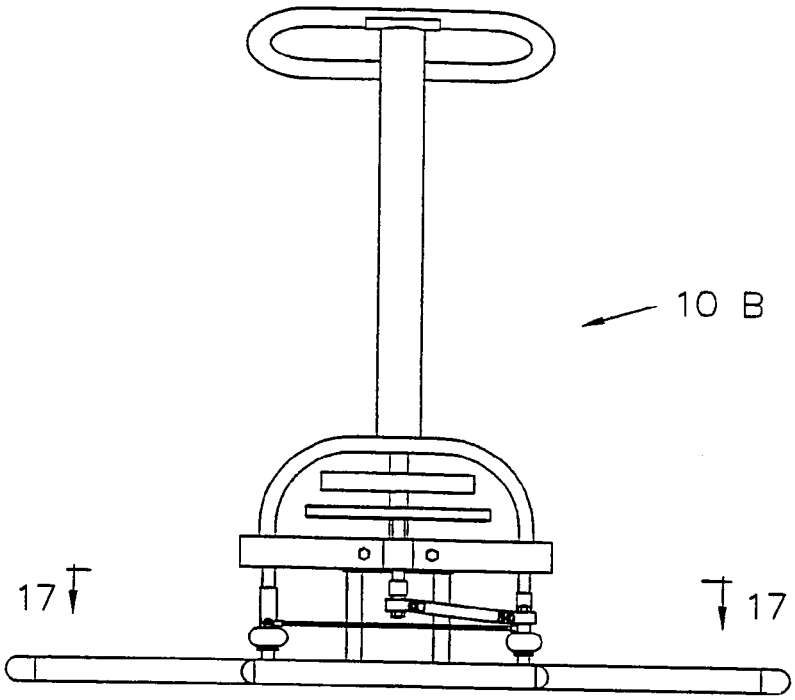
FIG. 16 is a front elevational view of another alternative embodiment of the present invention where the resilient tension means has been eliminated.
Figure 17:
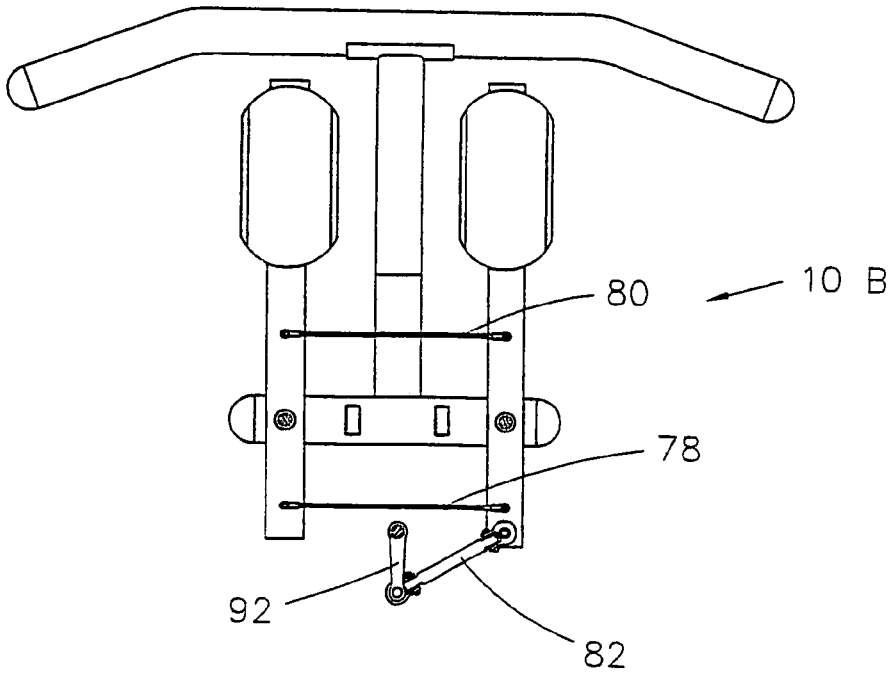
FIG. 17 is a cross-sectional view of the alternative embodiment of the skating machine illustrated in FIG. 16, as it would be seen along Line 17-17 of FIG. 16.
Figure 18:
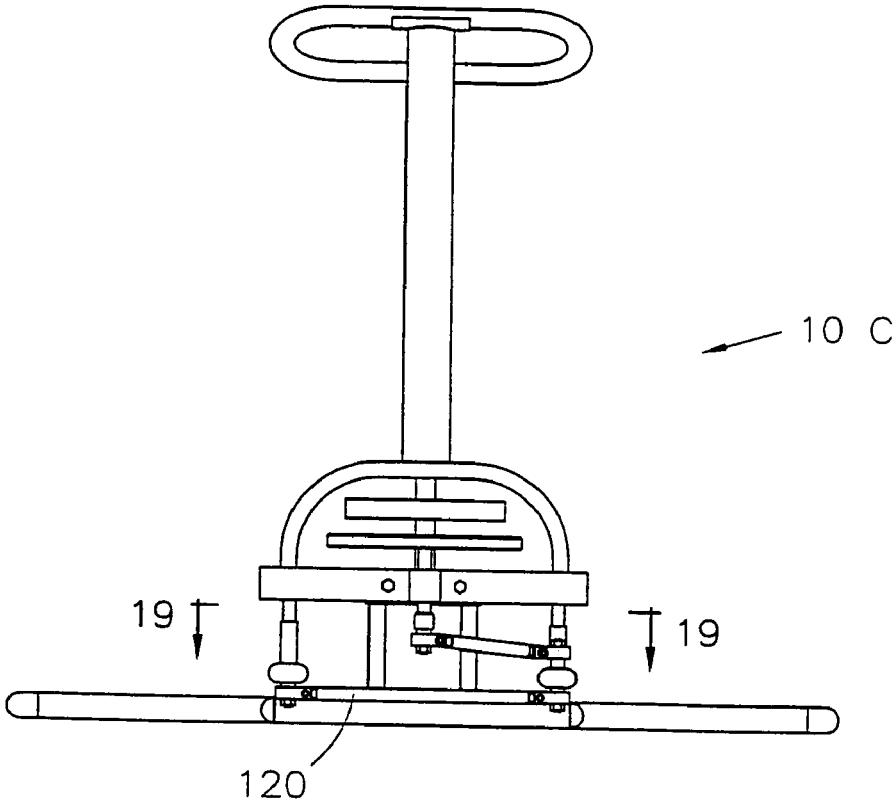
FIG. 18 is a front elevational view of another alternative embodiment of the present invention where the pair of flexible and inextensible cables in the embodiment illustrated in FIG. 16 has been replaced with a transverse rigid rod.
Figure 19:
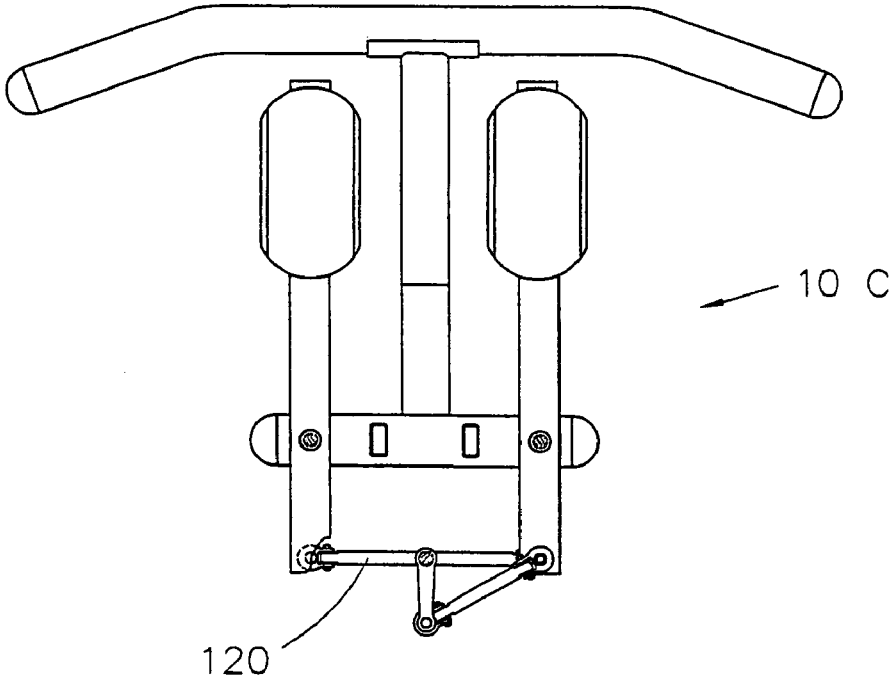
FIG. 19 is a cross-sectional view of the alternative embodiment of the skating machine illustrated in FIG. 18, as it would be seen along line 19-19 of FIG. 18.

Several more broadly described alternative embodiments of the present invention are illustrated in FIGS. 16 through 21. FIGS. 16 and 17 are intended to illustrate an alternative embodiment where the skating machine now called 10B is the same as the embodiment illustrated in FIGS. 1 through 13 but the resilient tension means 100 has been eliminated. The skating machine will work, but not as well as with the resilient tension means included. In FIGS. 16 and 17 the embodiment includes the flexible and inextensible cables 78 and 80 and once again, it will be appreciated that it is within the spirit and scope of the present invention to have at least one flexible and extensible cable, either 78 or 80, positioned anywhere along the length of the longitudinal pedal bars 32 and 42. In FIGS. 18 and 19, the flexible and inextensible cables 78 and 80 have been replaced with transverse rigid rod 120, comparable to the embodiment in FIGS. 14 and 15 but with the resilient tension means 100 also eliminated.

Figure 20:
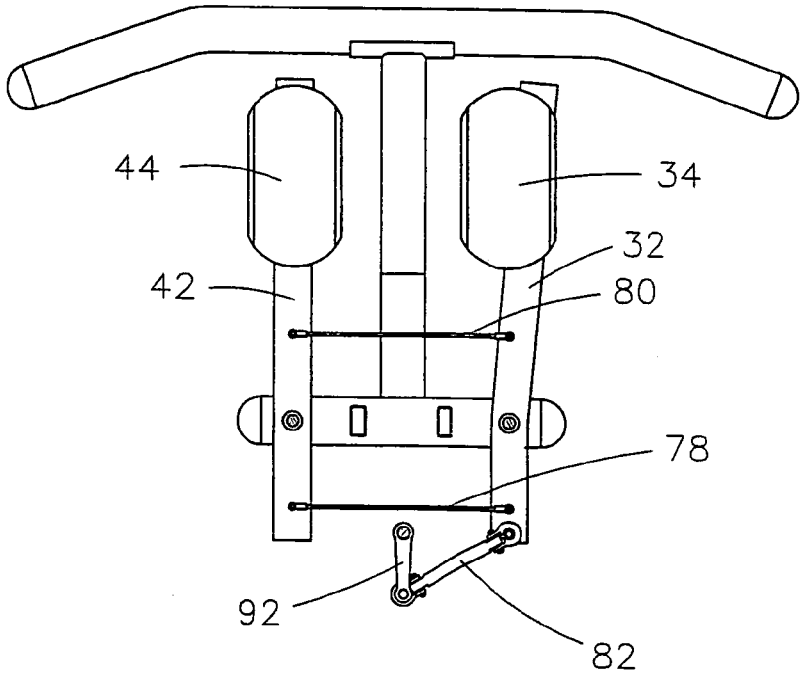
FIG. 20 is a sectional view of another alternative embodiment of the present invention skating machine where the tracks are not parallel and one track extends away from the other track.
Figure 21:
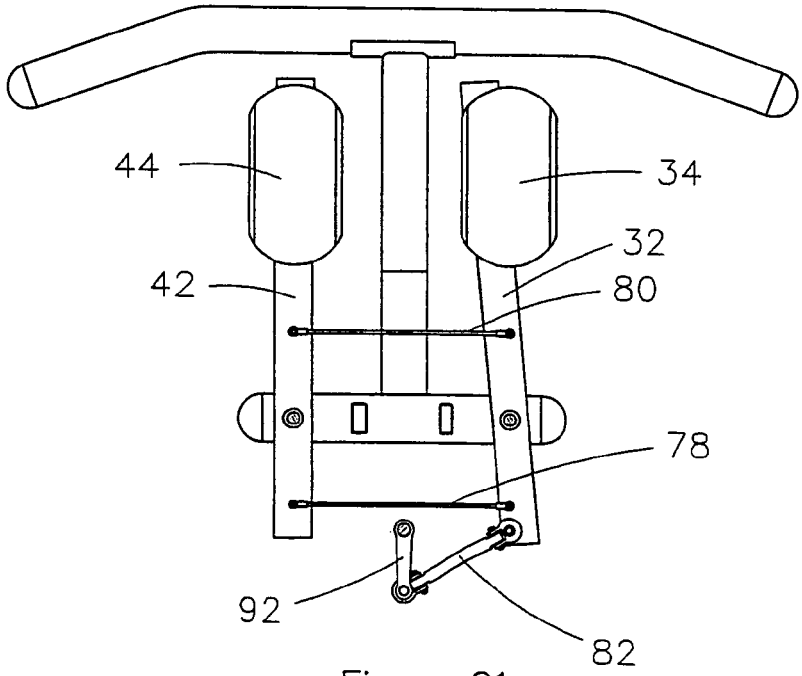
FIG. 21 is a sectional view of another alternative embodiment of the present invention skating machine where the tracks are not parallel and one track extends toward the other track.

Foot pedal assemblies 30 and 40 are side by side to each other and located along opposite sides of longitudinal frame 24. In the preferred embodiment illustrated in FIGS. 1 through 19, the foot pedal assemblies are parallel to each other. FIGS. 20 and 21 are intended to illustrate that it is also within the spirit and scope of the present invention to have embodiments where the pedal assemblies are side by side but not parallel. In the embodiment illustrated in FIG. 20, one pedal assembly extends away from the other pedal assembly. In the embodiment illustrated in FIG. 21, one pedal assembly extends toward the other pedal assembly. All of these variations are within the spirit and scope of the present invention.

Referring now to FIGS. 22-31, there is illustrated an improved embodiment 110 of the present invention skating machine, as compared with the first embodiment 10 which has been illustrated through FIGS. 1 to 21. Comparing the embodiment 10 illustrated in FIG. 1 with the improved embodiment 110 disclosed in FIG. 22, it will be appreciated that design of the improved skating machine 110 consistently follows the objective for the skating machine 10 to achieve the maximum smoothness in operation of the machine, when utilizing a front and rear elongated spring 278 and 280 in FIG. 22 which respective replace the respective elongated rods 78 and 80 in FIG. 1. The present invention also incorporates various different types of elastic mechanical parts to improve smoothness of the improved embodiment 110 of the skating machine in operation.

Referring to FIGS. 22 through 27, there is illustrated the improved skating machine 110 which is supported on a rear transverse base frame 220, and a front transverse base frame 222 which are interconnected by a longitudinal base frame 224. The skating machine 110 further comprises a first pedal assembly 230 having a first longitudinal pedal bar 232 to which a first foot pedal 234 is connected. The first longitudinal pedal bar 232 is rotatably connected to the front transverse base frame 222 by a first rod 236. The skating machine 110 further comprises a second pedal assembly 240 having a second longitudinal pedal bar 242 to which a second foot pedal 244 is connected. The second longitudinal pedal bar 242 is rotatably connected to the front transverse base frame 222 by a second rod (not shown).

First and second foot pedal assemblies 230 and 240 are spaced apart, and are placed side-by-side to each other and located along opposite sides of the longitudinal base frame 224. The rods 236 and 246 are also connected to an upper transverse frame 250 which supports a semicircular frame 252 to which is connected a handle post 254 which supports a handlebar 256. A pair of identical upper and lower rearward and longitudinal bars 258 is respectively located, wherein the upper one is positioned at the center of the semicircular frame 252 and the lower on is positioned at the center of the upper transverse frame 250, so that the upper and lower bars are aligned with each other in a vertical orientation. The paired bars 258 through a connecting rod of flywheel axle 260 rotatably support a flywheel 262. The flywheel 262 is connected to a collar or pulley 264 (see FIG. 24) so that the collar or pulley 264 will rotate with the flywheel 262.

A forward extending bar 266, which is aligned with the lower rearward longitudinal bar 258, is supported on the center of the upper transverse frame 250 and through a connecting rod or pulley axle 268 rotatably supports a pulley wheel 270 which has a circumferential channel 272 into which is supported a connecting band 274. The connecting band 274 is also connected to a collar or pulley 264, and as the pulley wheel 270 rotates, the flywheel 262 also rotates. The pulley wheel 270 is connected to the connecting rod 268 by mounting bracket 276. The purpose of the flywheel 262 is to add resistance to the rotation of the pulley wheel 270. By way of example only, the flywheel 262 can be a weighted magnetic flywheel having a multiplicity of magnets 263.

Figure 26:
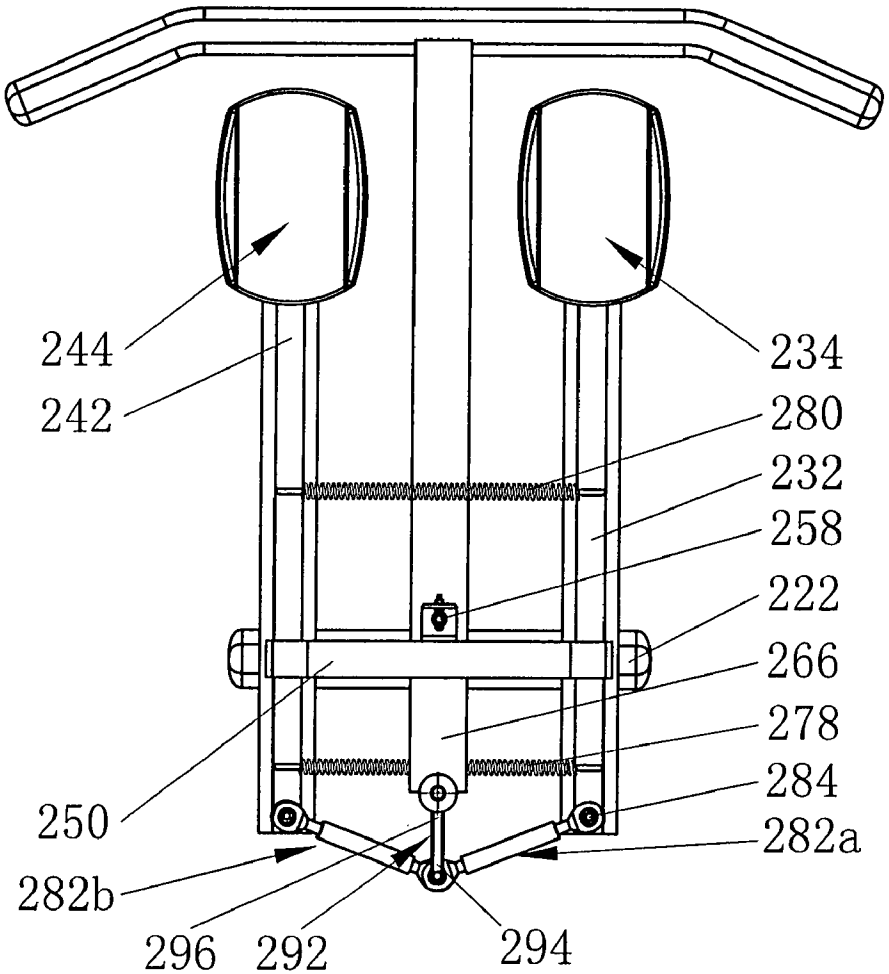
FIG. 26 is a cross-sectional view of the improved skating machine as it would be seen along Line 26-26 of FIG. 23.

The new innovative features of the present invention improved skating machine 110 will now be described. As best illustrated in FIG. 26, a first elongated transverse spring 278 connects the first and second longitudinal pedal bars 232 and 242 adjacent their front ends, wherein the spring is located in front of the front transverse frame 222. Similarly a second elongated transverse spring 280 which is positioned behind front transverse frame 222 connects adjacent a portion of the longitudinal pedal bars 232 and 242. As compared with the first and second flexible cable 78 and 80 in prior design shown in FIG. 6, it will be appreciated that application of the first and second elongated transverse spring 278 and 280 provides an improvement of smoothness in machine operation due to the elasticity of the springs.

Figure 22:
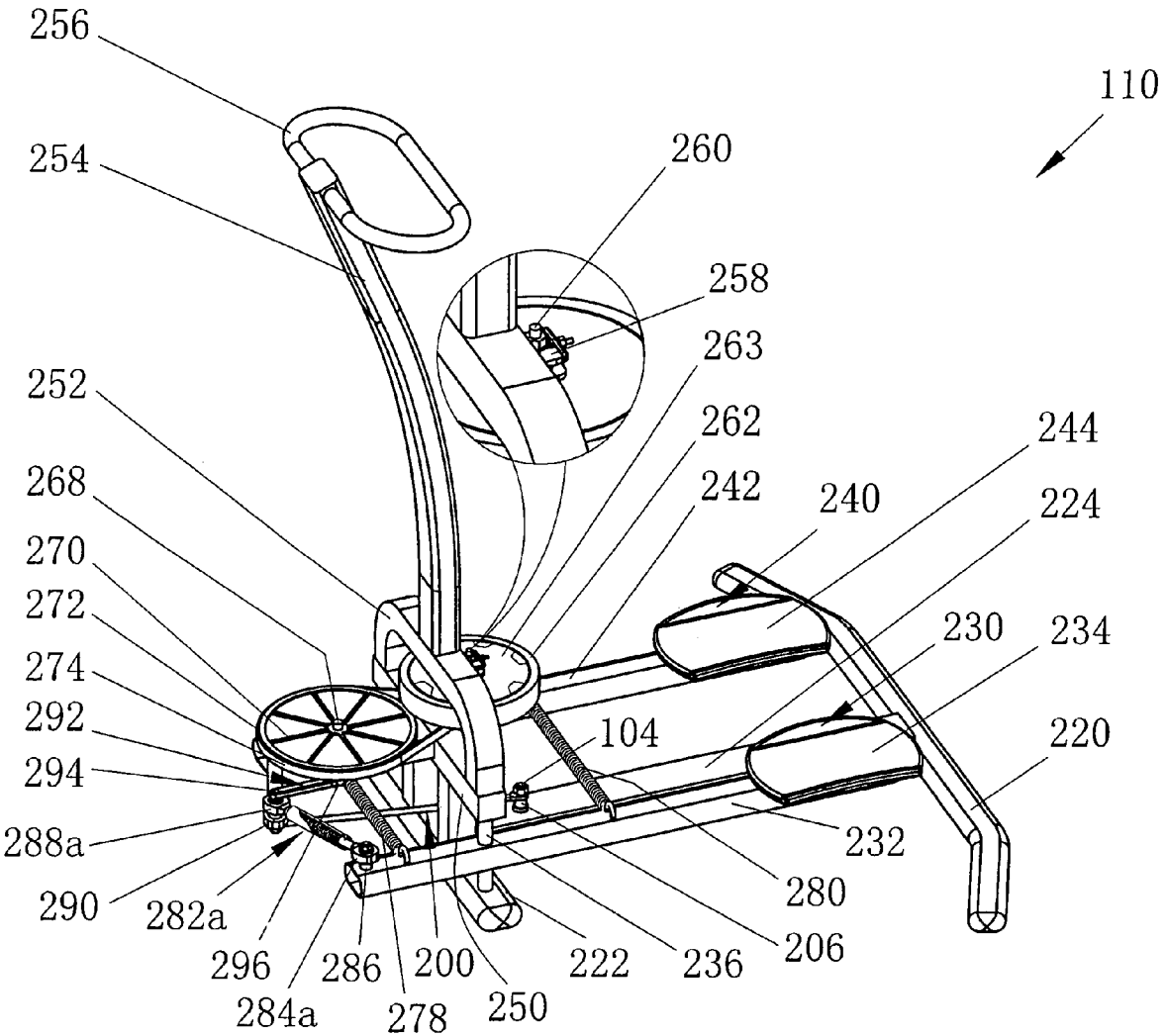
FIG. 22 is a perspective view of an improved embodiment of the present invention skating machine, which is an improvement over the embodiment which is illustrated in FIG. 1.

In addition to having the elastic springs 278 and 280, the improved skating machine 110 is further comprised of an elongated pedal connector flexible bar **282*a*, which is another one of the key improved structural parts of the present invention. As illustrated in FIG. 22, the flexible bar 282*a* is rotatably connected at its first end 284*a* to the front of the first longitudinal pedal bar 232 by rod means 286 and is rotatably connected at its second end 288*a* to a crank axle 290**.

Figure 22A:
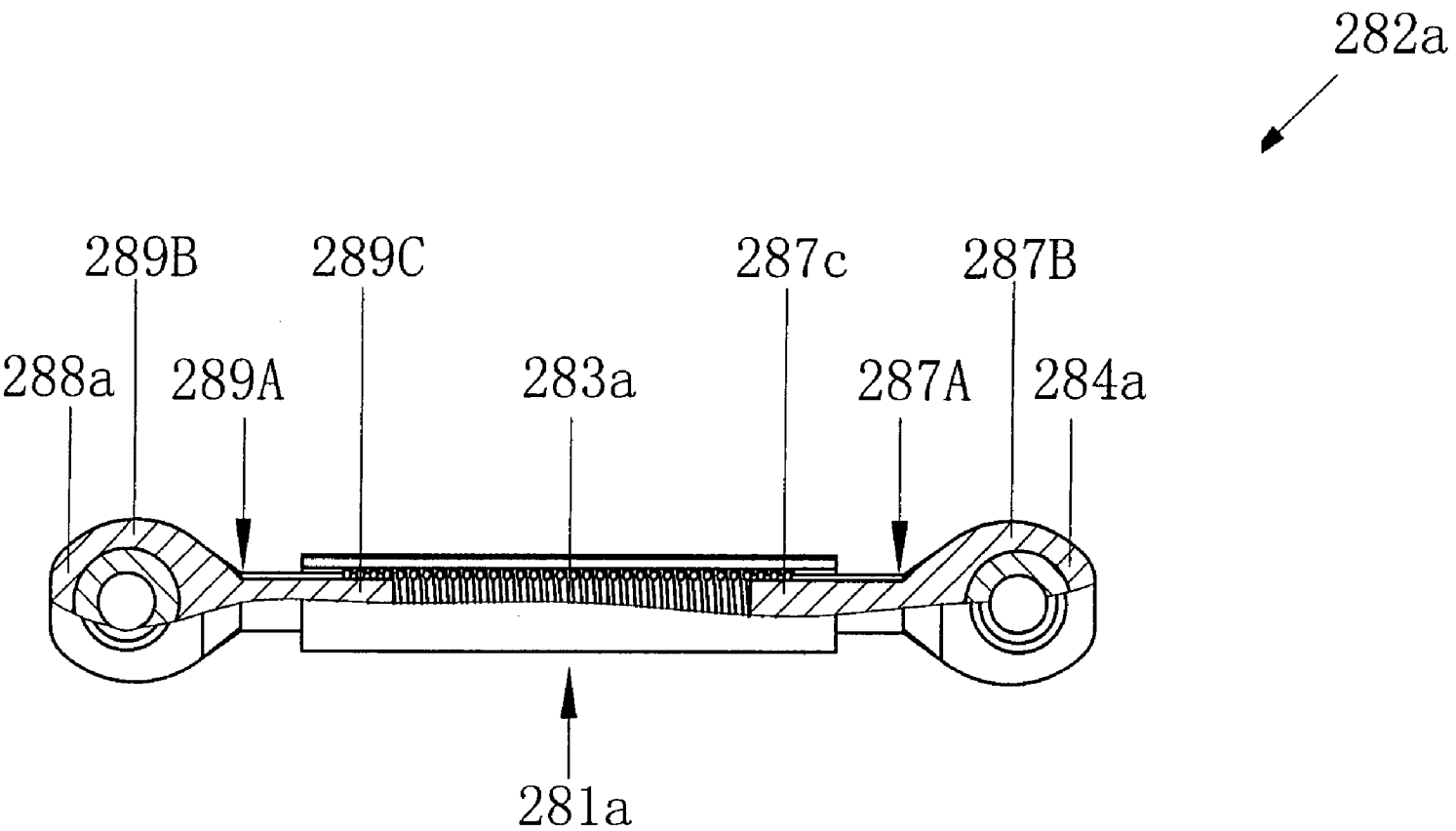
FIG. 22A is an enlarged view of a first pedal connector flexible bar.
Figure 22B:
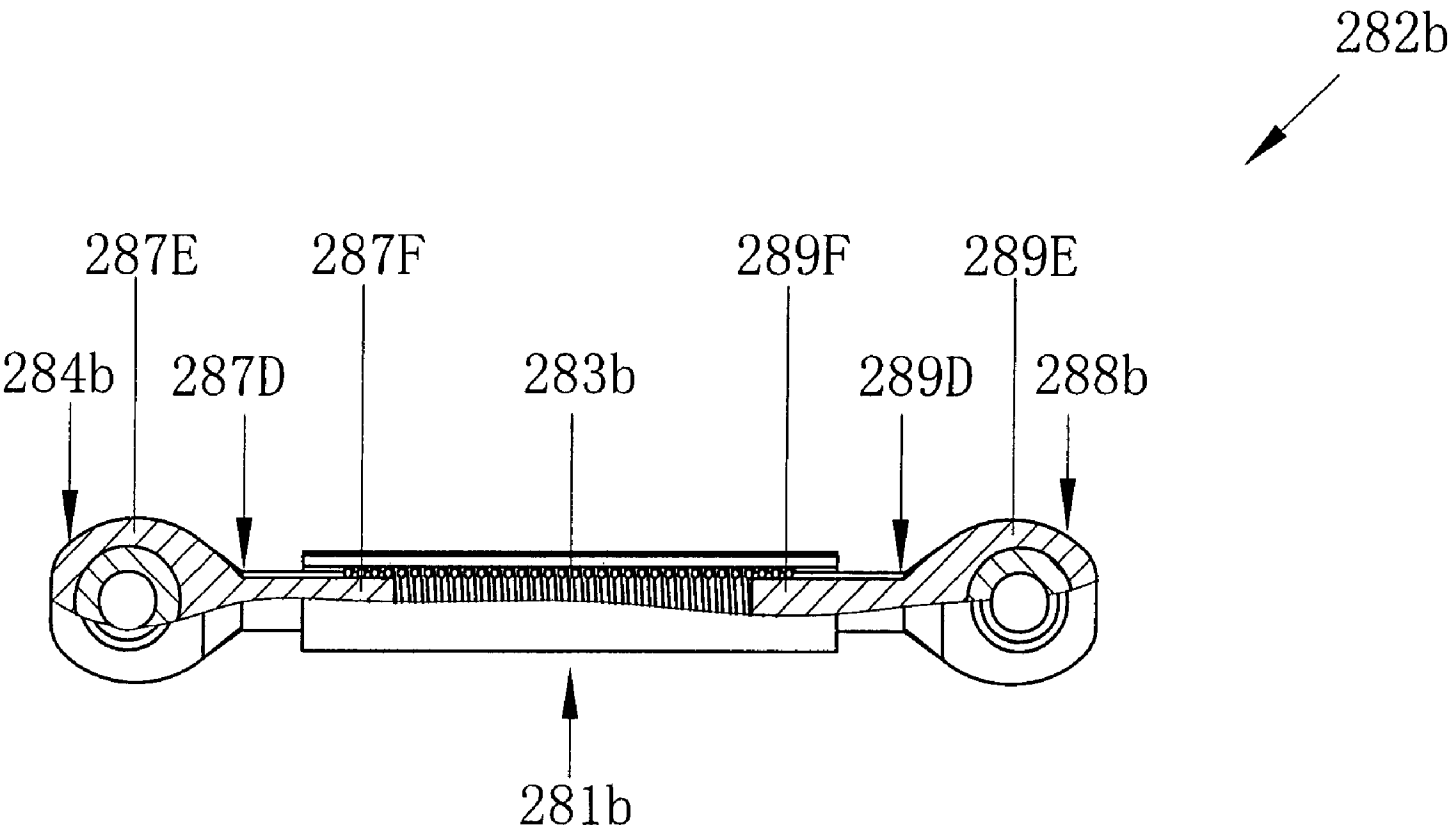
FIG. 22B is an enlarged view of a second pedal connector flexible bar.
Figure 23:
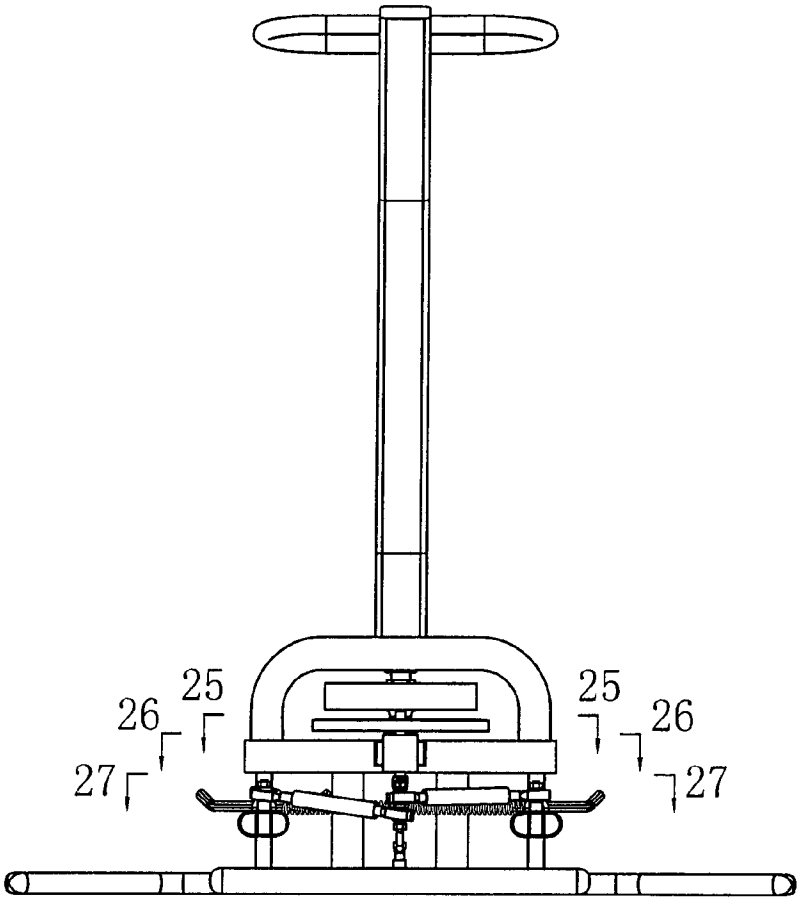
FIG. 23 is a front elevational view of the improved embodiment of the skating machine illustrated in FIG. 22.

Further referring to FIG. 22A, the flexible bar **282*a* is comprised of a first sleeve 287A having an outer end 287B and an inner end 287C, a second sleeve 289A which is identical to the first sleeve having an outer end 289B and inner end 289C, a hollow rod 281*a*, and a spring 283*a*. When the flexible bar 282*a* is assembled, the spring 283*a* is placed in the middle of the hollow rod 281*a*. The inner end 287C of the first sleeve 287A is thereby inserted into the hollow rod 281*a* from one side to affix to rest against the middle spring 283*a*. Similarly, the inner end 289C of the second sleeve 289A is inserted into the hollow rod 281*a* from the opposite side to rest against the middle spring 283*a*. Therefore, the outer ends 287B and 289B of the respective first and second sleeves of the flexible bar serves as the respective first and second ends 284*a* and 288*a* of the flexible bar 282*a***.

After connecting the second end **288*a* through the crank axle 290, there is a crank 292 which is connected at its first end 294 to the crank axle 290 and connected at its second end 296 to the connecting rod or pulley axle 268 to which the pulley wheel 270 is also connected. Therefore, the crank 292 can be driven to rotate around the pulley axle 268. Having the above disclosed structure, it will be appreciated that application of the flexible bar 282*a* contributes significantly to the smoothness of the operation of the machine. The elasticity of the flexible bar 282 prevents the crank 292 from locking at a "dead" angle when the flexible bar 282*a* and the crank 292 are aligned with each other, thereby preventing the skating machine 210** from being "frozen".

As best illustrated in FIG. 26, during the crank rotation, there are two moments at which the respective "dead" angle occurs. One occurs at a moment of the alignment of the flexible bar **282*a* and the crank 292 when a projection of the first end 294 of the crank 292 is positioned between the forward extending bar 266 and the first longitudinal peddle bar 232. At that moment, the flexible bar 282***a* is maximumly compressed, which correlates to the first "dead" angle of the crank rotation for the flexible bar. However, because of the elastic energy provided by the spring 283*a*, it helps to push the crank first end 294 past the dead angle. Another one happens at a moment of the alignment of the flexible bar 282*a* and the crank 292 when the projection of the first end 294 of the crank 292 is positioned between the forward extending bar 266 and the second longitudinal peddle bar 242. At that moment, the flexible bar 282*a* is maximumly expanded, which correlates to the second "dead" angle of the crank rotation for the flexible bar. However, because of the elastic energy provided by the spring 281*a*, it helps to pull the crank first end 294 past the dead angle.

As further illustrated in FIG. 26 and FIG. 22 B, a variation of this innovation is the addition of a second flexible bar 282*b*, which is identical to the first flexible bar 282*a*. The second flexible bar 282*b* is comprised of a first sleeve 287D having an outer end 287E and an inner end 287F, a second sleeve 289D which is identical to the first sleeve having an outer end 289E and inner end 289F, a hollow rod 281*b*, and a spring 283*b*. When the flexible bar 282*b* is assembled, the spring 283*b* is placed in the middle of the hollow rod 281*b*. The inner end 287F of the first sleeve 289D is thereby inserted into the hollow rod 281*b* from one side to affix to rest against the middle spring 283*b*. Similarly, the inner end 289F of the second sleeve 289D is inserted into the hollow rod 281*b* from the opposite side to rest against the middle spring 283*b*. Therefore, the outer ends 287E and 289E of the respective first and second sleeves of the flexible bar serves as the respective first and second ends 284*b* and 288*b* of the flexible bar 282*b*. The second bar 282*b* is at its second end 288*b* is connected to the crank axle 290, and at its first end 284*b* to connect to the front end of the second longitudinal foot peddle bar 242. Therefore, it will be appreciated that when the rotation of the crank 292 is at the first dead angle for the first flexible bar 282*a*, that is the crank is aligned with the first flexible bar 282*a*, then the crank is not aligned with the second flexible bar 282*b* which is at an expended position. Therefore, the first flexible bar 282*a* will provide a pushing force and the second flexible bar 282*b* will provide a pulling force on the first end 294 of the crank 292, which thereby causes the crank rotation pass the first "dead" angle for the first flexible bar 282*a*.

Figure 31:
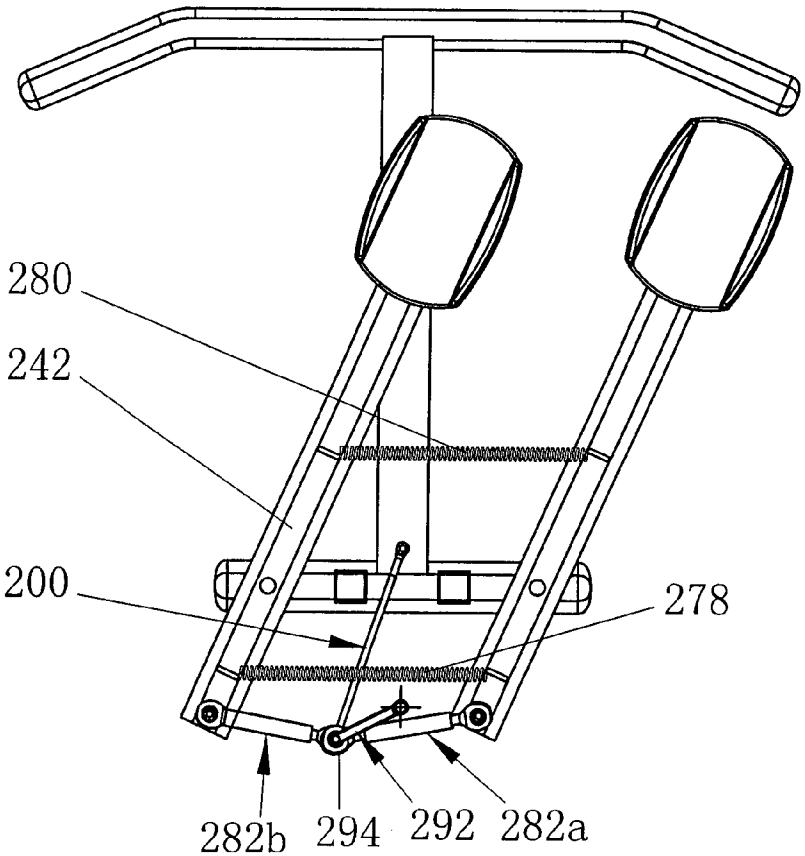
FIG. 31 is a cross-sectional view of the skating machine as it would be seen along Line 27-27 of FIG. 23 with the crank rotated to a position where its long body is aligned with the first pedal connector flexible bar, and the first end of the crank is positioned close the second pedal longitudinal bar, wherein the position correlates the second "dead" angle of the crank rotation for the first pedal connector flexible bar.

Alternatively, when the rotation of the crank 292 is at the second "dead" angle for the first flexible bar 282*a*, as illustrated in FIG. 31, the crank 292 is also not aligned with the second flexible bar 282*b* which is at a compressed position. Therefore, the first flexible bar 282*a* will exert a pulling force and the second flexible bar 282*b* will exert a pushing force on the first end 294 of the crank 292 to enable it to pass the second "dead" angle for the first flexible bar 282*a*. It will be appreciated that there will be also the first and second "dead angle" of the crank rotation for the second flexible bar 282*b*. However, the respective position for such "dead angle" is inversely symmetric to the respective positions of the respective first and second "dead angle" for the first flexible bar 282*a*, which can be easily understood.

Figure 24:
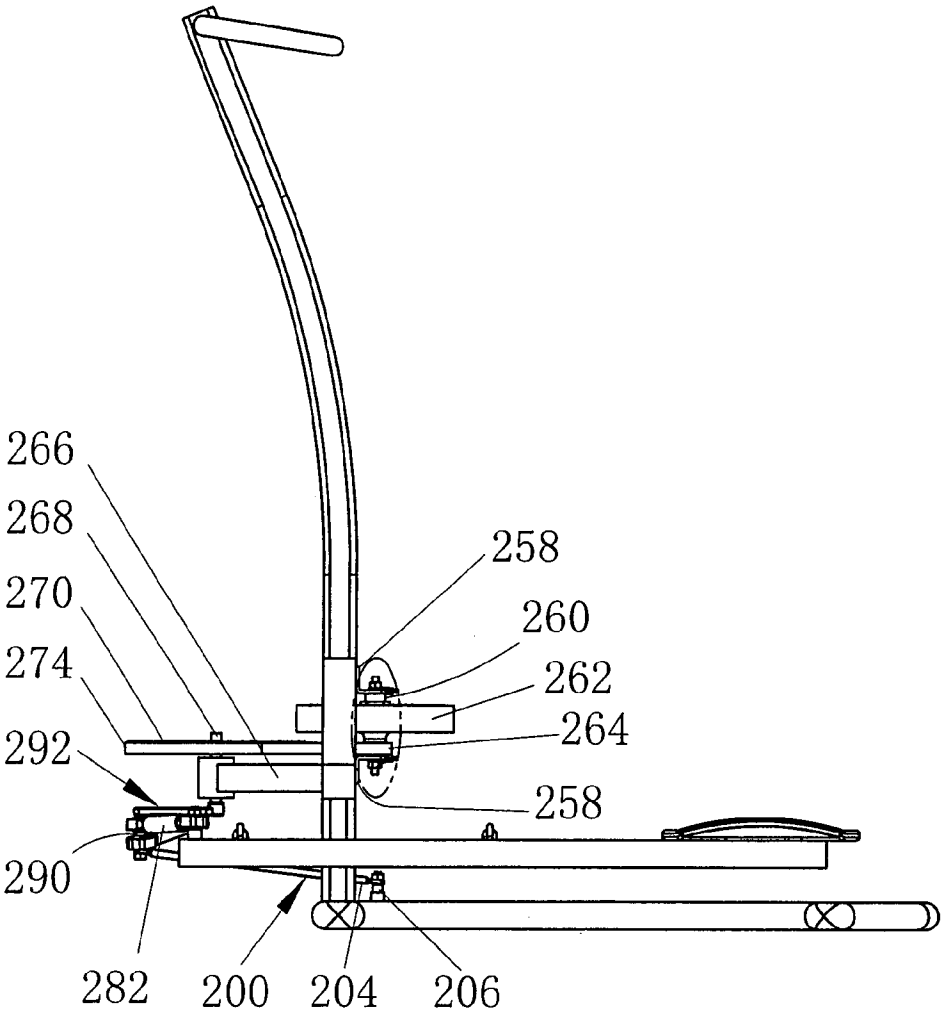
FIG. 24 is a side elevational view of the improved embodiment of the skating machine illustrated in FIG. 22.
Figure 27:
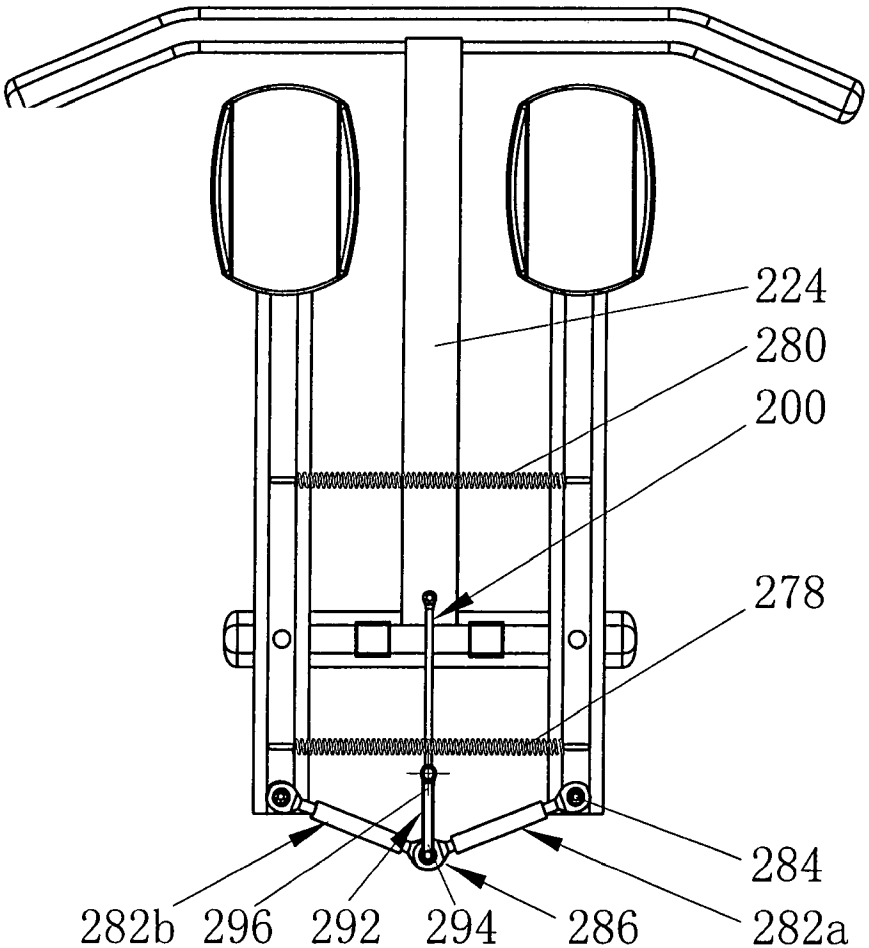
FIG. 27 is a cross-sectional view of the improved skating machine as it would be seen along Line 27-27 of FIG. 23.

In addition to the flexible bars 282*a* and 282*b*, an additional key innovation of the present invention skating machine 110 is the further addition of a resilient tension means 200 which by way of example can be a bungee cord. The resilient tension means 200 is connected at one end 202 to the crank axle 290 and is connected at its opposite end 204 to a post 206 which is connected at its opposite end to longitudinal frame 224. The preferred embodiment as illustrated in FIGS. 22, 24 and 27 has the post 206 connected to the longitudinal frame 224 at a location behind front transverse frame 222. It is also within the spirit and scope of the present invention to have the post 206 connected at other locations on the skating machine, by way of example, to the front transverse frame 222. The addition of the stretchable tension means or bungee cord 200 is a key innovation because it additionally prevents the pedal connector bars 282*a* and 282*b* and crank 292 from locking at a "dead" angle when they are aligned with each other to thereby prevent the skating machine 110 from being "frozen".

Having the above illustrated improvement on the structure of the skating machine, a systematic study has been conducted to elaborate how the addition of the flexible parts affects the increase of smoothness in operation of the improved machine. Experimental results have established that seventy percent (70%) of the desired smoothness can be achieved by using only the first and second flexible bars 282*a* and 282*b* for the improved skating machine. Therefore, one broad variation on the present invention is to have only the first and second flexible bars. The actual smoothness can be increased to eight-five percent (85%) with two flexible bars 282*a* and 282*b* and the rear side elongated spring 280 being utilized. This combination provides a second additional embodiment for the present invention. If the front side elongated spring 278 is added, ninety-eight percent (98%) of the desired smoothness can be achieved. This combination provides a third alternative embodiment. Finally, if the resilient tension means 200 is added, a full scale or one-hundred percent (100%) of the smoothness can be conducted. This combination provides a fourth alternative embodiment.

Figure 25:
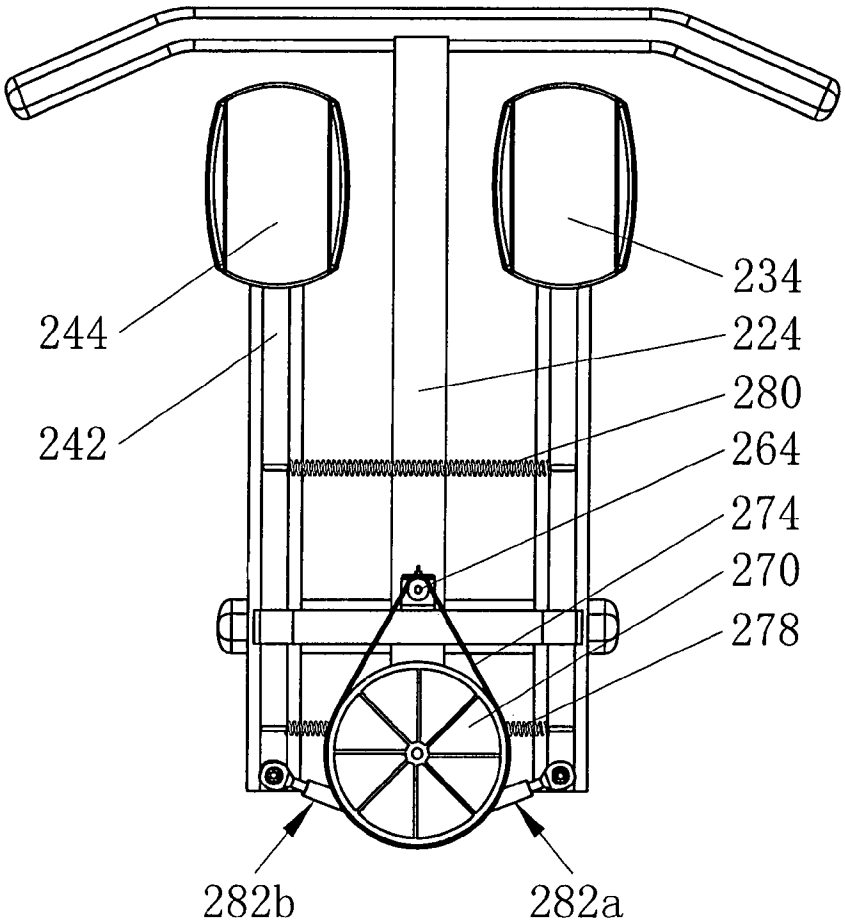
FIG. 25 is a cross-sectional view of the improved skating machine as it would be seen along Line 25-25 of FIG. 23.

The operation of the skating machine 110 will now be described. A user stands on the skating machine 110 so that the user's left foot rests in first foot pedal 234 and the user's right foot rests in second foot pedal 244. The user holds onto handlebar 256 and is ready to exercise. In correlating this situation, FIG. 25 illustrates a top view of the improved machine 110 without showing the upper structure including the handle, handle bar, and the semi-circular frame. FIG. 26, which is based on illustration of FIG. 25, illustrates the structural parts of the machine but without showing the resistance system including the flywheel, the pulley, and flywheel belt. As illustrated, the first longitudinal peddle bar 232 and the first flexible bar 282*a* are positioned as a mirror image to their counterparts, the second peddle bar 242 and flexible bar 282*b*, relative to the longitudinal base frame 224 and the crank 292 which acts as a symmetric axis of the mirror image. FIG. 27, which is based on the illustration of FIG. 26, illustrates the structural parts but without showing the upper transverse frame 250 connected to the forward extending bar 266 and the lower rearward extending bar 258. The resilient tension means 200, which is connected to the crank 292 is illustrated to be aligned with the base longitudinal frame 224.

Figure 28:
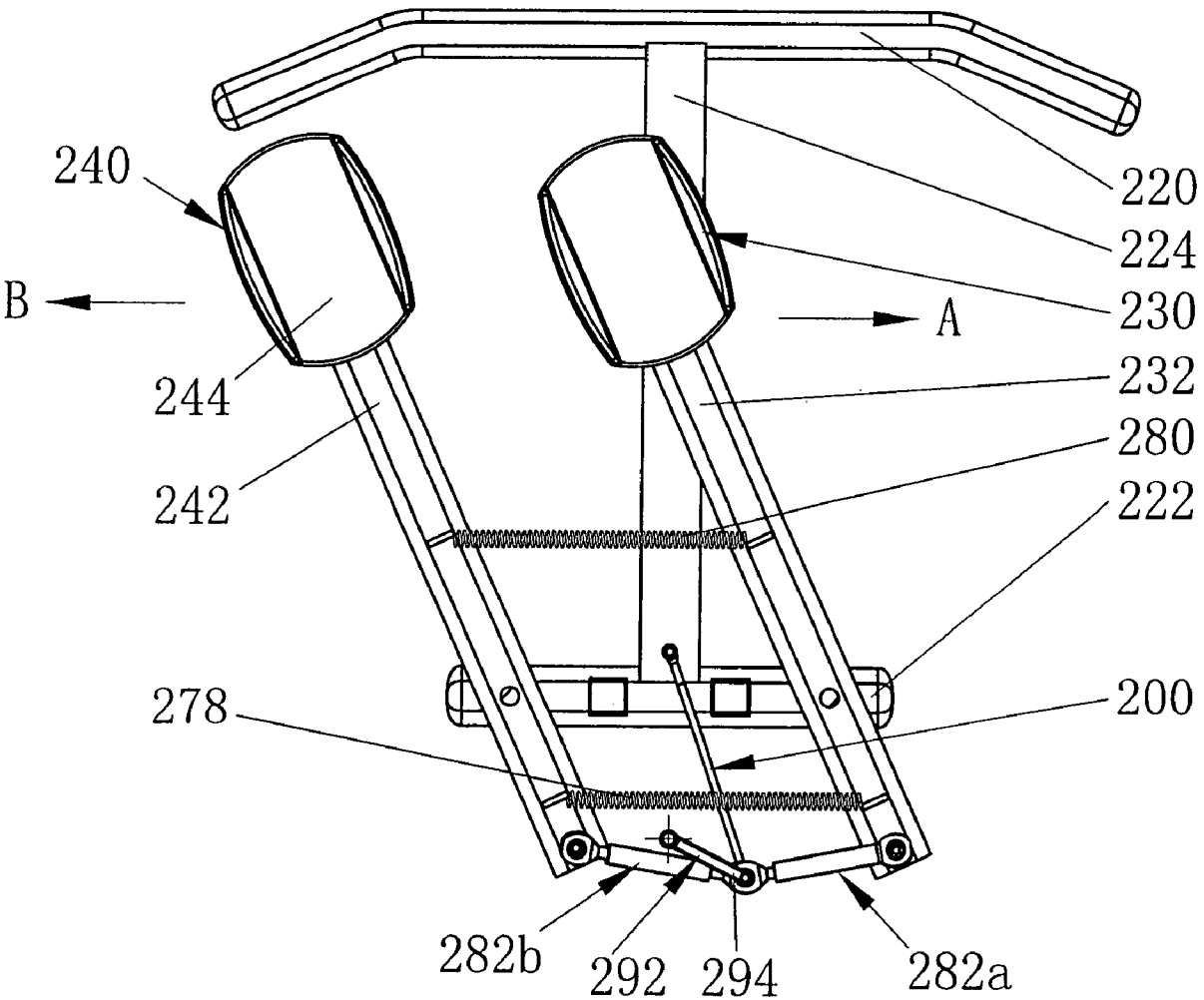
FIG. 28 is a cross-sectional view of the skating machine as it would be seen along Line 27-27 of FIG. 23 with the crank rotated 90 degrees counterclockwise.

Referring to FIG. 28, the are illustrated the positions of the rotatable parts, and movable parts including the front and rear elongated spring 278 and 280, relative to the stationary longitudinal base frame 224 and transverse base frames 220 and 222 when the user is exercising on the machine wherein the first pedal assembly 230 and second pedal assembly 240 are rotated to the right in the direction of arrow B. The crank 292 is rotated less than 90 degrees counterclockwise from its position in FIG. 27, and is close to the first "dead" angle where the crank 292 and the first and second flexible bars 282*a* and 282*b* are nearly aligned. It will be appreciated that because of the elastic energies stored to the elastic parts 282*a*, 282*b*, 278 and 280 in addition to the resilient extension means 200, the smooth rotation of the crank 292 can easily pass the first "dead" angle in a continuous fashion.

Figure 29:
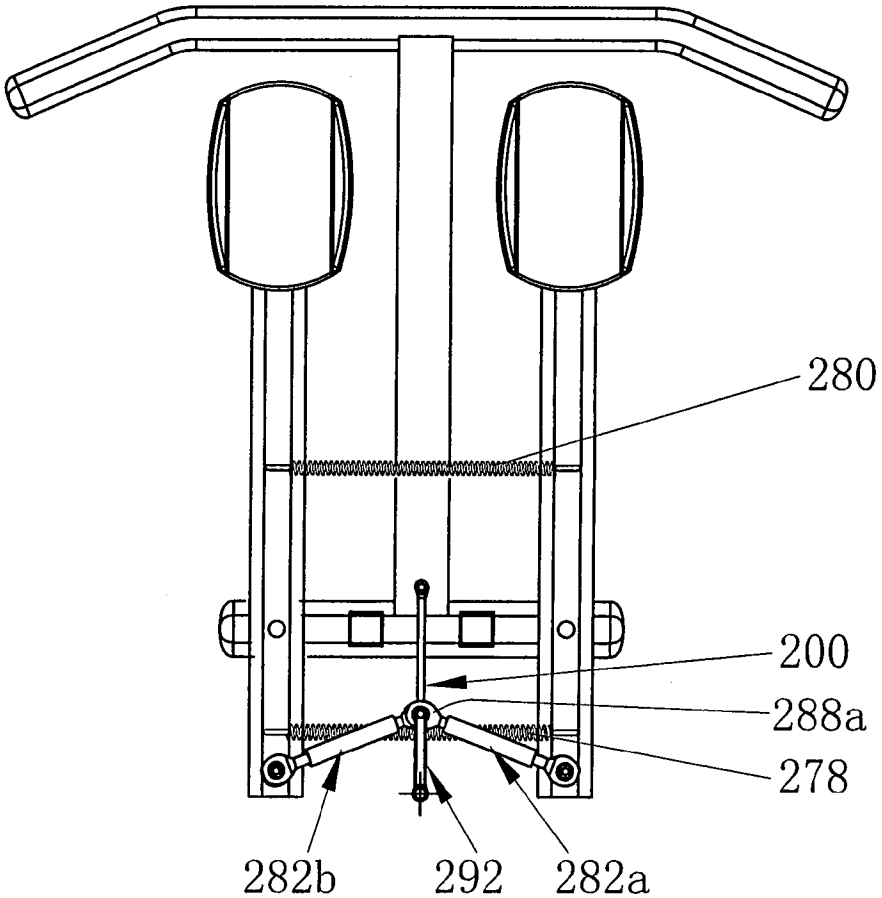
FIG. 29 is a cross-sectional view of the skating machine as it would be seen along Line 27-27 of FIG. 23 with the crank rotated 180 degrees counterclockwise.

In FIG. 29, there is illustrated the condition where the crank 292 has completed a 180 degree rotation counter-clockwise from its position in FIG. 27. In this new position, all the movable and rotatable parts are symmetrically positioned again, as compared with the positions shown in FIG. 27. However, a difference is that the first end of the crank 292 and the second ends 288*a* and 288*b* of the first and second flexible bars 282*a* and 282*b* are rearwardly orientated.

Figure 30:
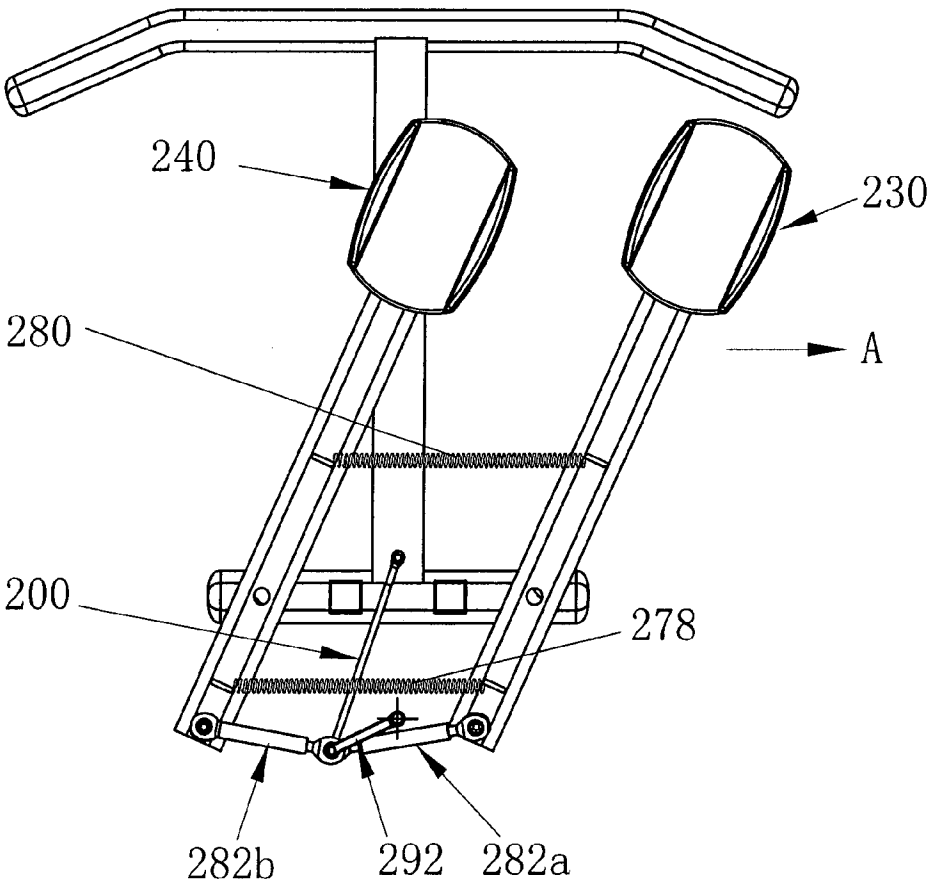
FIG. 30 is a cross-sectional view of the skating machine as it would be seen along Line 27-27 of FIG. 23 with the crank rotated 270 degrees counterclockwise.

Referring to FIG. 30, there is illustrated the condition where the user has caused the first pedal assembly 230 and second pedal assembly 240 to rotate to the left in the direction of arrow A. In this setting, the crank 292 has just rotated to pass the second "dead" angle position, as previously illustrated. It will be appreciated that due to the elastic energies from all the elastic parts, the crank 292 is able to easily pass the second "dead" angle for the first flexible bar 282*a* in a smooth manner, and is continuously on its way for finishing a full cycle of rotation, which is illustrated in FIG. 31.

It will also be appreciated that while two elongated spring 278 and 280 are illustrated in the preferred embodiment, it is also within the spirit and scope of the present invention to have at least one spring either 278 or 280, and positioned anywhere along the lengths of longitudinal pedal bars 232 and 242.

As the side to side motion is taking place, the pulley wheel 270 is rotating and resistance is provided by the interconnected flywheel 262 which is also rotating due to the interconnecting band 274 connecting the pulley wheel 270 to the pulley 264 of the flywheel 262. A resistance variation means connected to the flywheel 262 permits the user to increase or decrease the amount of resistance created by the flywheel 262.

Through use of the present invention, an improved skating machine is provided with a smooth side to side skating action which will not lock or freeze at the extreme left or right sideways position. While the skating machine 110 has been illustrated with a maximum side to side angle of approximately 45 degrees, it will be appreciated that the angle can be increased to any larger desired angle by increasing the length of the first and second pedal connector bar 282*a* and 282*b*, or just one of them. The angle can be decreased by decreasing the length of the pedal connector bars, or just one of them. It will also be appreciated that the opposite end of the tension means 200 remote from the intersection of the crank 292 and the pedal connector bars can be attached at any desired location on a portion of the base frames of the skating machine.

It will be appreciated that foot pedal assemblies 230 and 240 are side by side to each other and located along opposite sides of longitudinal frame 224. In addition to the preferred embodiment illustrated in FIGS. 22 through 31, however, it is also within the spirit and scope of the present invention to have embodiments where the pedal assemblies are side by side but not parallel. Concept of this embodiment is the same as that illustrated in the respective FIGS. 20 and 21, which has been previously discussed.

Defined in detail, the present invention is a An improved skating machine comprising: (a) a rear transverse base frame, a front transverse base frame and a longitudinal base frame interconnecting the front and rear transverse base frames; (b) a first pedal assembly further comprising a first longitudinal pedal bar having a first foot pedal attached adjacent one end and means to rotatably connect the first longitudinal pedal bar to the front transverse frame at a location between the first foot pedal and the opposite end of the first longitudinal pedal bar; (c) a second pedal assembly further comprising a second longitudinal pedal bar having a second foot pedal attached adjacent one end and means to rotatably connect the second longitudinal pedal bar to the front transverse frame at a location between the second foot pedal and the opposite end of the second longitudinal pedal bar, the first and second pedal assemblies being side-by-side to each other and located on opposite sides of the longitudinal frame; (d) a transverse upper frame to which is connected a semi-circular frame to which is connected a handle post to which is connected a handlebar, a lower rearwardly extending longitudinal bar connected to said transverse upper frame and a forwardly extending longitudinal bar connected to said transverse upper frame, and an upper rearwardly extending longitudinal bar connected to said a semi-circular frame; (e) an axle supported on said upper and lower rearwardly extending longitudinal bars to which is rotatably connected a flywheel and a pulley, a pulley axle supported on said forwardly extending longitudinal bar which is connected to a pulley wheel, the pulley wheel and the pulley of the flywheel being interconnected by a connecting band so that the pulley wheel and the flywheel rotate together; (f) an identical first and second pedal connector flexible bar rotatably connected at their respective outer end to a respective first and second longitudinal pedal bar and rotatably connected at their respective opposite inner end to a crank axle, a crank connected at one end to the crank axle and connected at its opposite end to the pulley axle; (g) a resilient tension means connected at one end to the crank axle and connected at its opposite end to a post which is attached to a portion of said longitudinal base frame; and (h) transverse interconnecting elastic means transversely interconnecting the first and second longitudinal pedal bars.

Defined more broadly, the present invention is a An improved skating machine comprising: (a) a base frame assembly having at least a transverse base frame and a longitudinal base frame; (b) a first pedal assembly having a foot pedal adjacent one end and rotatably connected to said transverse frame; (c) a second pedal assembly having a foot pedal adjacent one end and rotatably connected to said transverse frame, the first and second pedal assemblies being side-by-side and located on opposite sides of the longitudinal frame; (d) a frame assembly which supports a handle bar post and a handlebar connected thereto, the frame assembly further comprising means to support a rear axle and a front pulley axle, a flywheel and a pulley rotatably connected to the rear axle, a pulley wheel connected to the front pulley axle, the pulley wheel and the pulley of the flywheel being interconnected by a connecting band so that the pulley wheel and the flywheel rotate together; and (e) a first pedal connector flexible bar and a second pedal connector flexible bar each rotatably connected at their respective outer end to a respective first and second pedal assembly and rotatably connected at their respective opposite inner end to a crank axle, a crank connected at one end to the crank axle and connected at its opposite end to the pulley axle.

Defined most broadly, the present invention is a An improved skating machine comprising: (a) a base frame assembly having at least a transverse base frame and a longitudinal base frame; (b) a first pedal assembly having a foot pedal adjacent one end and rotatably connected to said transverse frame; (c) a second pedal assembly having a foot pedal adjacent one end and rotatably connected to said transverse frame, the first and second pedal assemblies being side-by-side and located on opposite sides of the longitudinal frame; (d) a frame assembly which supports a resistance means; and (e) a first pedal connector flexible bar and a second pedal connector flexible bar each rotatably connected at their respective outer end to a respective first and second pedal assembly and rotatably connected at their respective opposite inner end to a crank axle, a crank connected at one end to the crank axle and connected at its opposite end to said resistance means.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An improved skating machine comprising:

a. a rear transverse base frame, a front transverse base frame and a longitudinal base frame interconnecting the front and rear transverse base frames;

b. a first pedal assembly further comprising a first longitudinal pedal bar having a first foot pedal attached adjacent one end and means to rotatably connect the first longitudinal pedal bar to the front transverse frame at a location between the first foot pedal and the opposite end of the first longitudinal pedal bar;

c. a second pedal assembly further comprising a second longitudinal pedal bar having a second foot pedal attached adjacent one end and means to rotatably connect the second longitudinal pedal bar to the front transverse frame at a location between the second foot pedal and the opposite end of the second longitudinal pedal bar, the first and second pedal assemblies being side-by-side to each other and located on opposite sides of the longitudinal frame;

d. a transverse upper frame to which is connected a semi-circular frame to which is connected a handle post to which is connected a handlebar, a lower rearwardly extending longitudinal bar connected to said transverse upper frame and a forwardly extending longitudinal bar connected to said transverse upper frame, and an upper rearwardly extending longitudinal bar connected to said a semi-circular frame;

e. an axle supported on said upper and lower rearwardly extending longitudinal bars to which is rotatably connected a flywheel and a pulley, a pulley axle supported on said forwardly extending longitudinal bar which is connected to a pulley wheel, the pulley wheel and the pulley of the flywheel being interconnected by a connecting band so that the pulley wheel and the flywheel rotate together;

f. an identical first and second pedal connector flexible bar rotatably connected at their respective outer end to a respective first and second longitudinal pedal bar and rotatably connected at their respective opposite inner end to a crank axle, a crank connected at one end to the crank axle and connected at its opposite end to the pulley axle;

g. a resilient tension means connected at one end to the crank axle and connected at its opposite end to a post which is attached to a portion of said longitudinal base frame; and h. transverse interconnecting elastic means transversely interconnecting the first and second longitudinal pedal bars.

2. An improved skating machine in accordance with claim 1, wherein said resilient tension means is a bungee cord.

3. An improved skating machine in accordance with claim 1, wherein each of said identical pedal connector flexible bars is comprised of an identical first and second sleeve having a respective outer and inner end, a hollow rod having a middle area and a spring, wherein the spring which is placed in the middle of the hollow rod rests adjacent a respective inner end of the respective first and second sleeves so that the respective outer ends of the first and second sleeves become the respective first outer end and second outer end of the respective pedal connector flexible bars.

4. An improved skating machine in accordance with claim 1, wherein said transverse interconnecting elastic means are two elongated springs attached to said first and second longitudinal pedal bars.

5. An improved skating machine in accordance with claim 4, wherein said transverse interconnecting elastic means are a first and second elongated spring attached to a respective front and rear portion of said first and second longitudinal pedal bars.

6. An improved skating machine in accordance with claim 1, wherein the first and second pedal assemblies are parallel to each other.

7. An improved skating machine in accordance with claim 1, wherein one pedal assembly extends toward the other pedal assembly.

8. An improved skating machine in accordance with claim 1, wherein one pedal assembly extends away from the other pedal assembly.

9. An improved skating machine comprising:

a. a base frame assembly having at least a transverse base frame and a longitudinal base frame;

b. a first pedal assembly having a foot pedal adjacent one end and rotatably connected to said transverse frame;

c. a second pedal assembly having a foot pedal adjacent one end and rotatably connected to said transverse frame, the first and second pedal assemblies being side-by-side and located on opposite sides of the longitudinal frame;

d. a frame assembly which supports a handle bar post and a handlebar connected thereto, the frame assembly further comprising means to support a rear axle and a front pulley axle, a flywheel and a pulley rotatably connected to the rear axle, a pulley wheel connected to the front pulley axle, the pulley wheel and the pulley of the flywheel being interconnected by a connecting band so that the pulley wheel and the flywheel rotate together; and e. a first pedal connector flexible bar and a second pedal connector flexible bar each rotatably connected at their respective outer end to a respective first and second pedal assembly and rotatably connected at their respective opposite inner end to a crank axle, a crank connected at one end to the crank axle and connected at its opposite end to the pulley axle.

10. An improved skating machine in accordance with claim 9, wherein each of said pedal connector flexible bars is comprised of a first and second sleeve having a respective outer and inner end, a hollow rod having a middle area and a spring, wherein the spring which is placed in the middle of the hollow rod rests adjacent a respective inner end of the respective first and second sleeves so that the respective outer ends of the first and second sleeves become the respective first outer end and second outer end of the respective pedal connector flexible bars.

11. An improved skating machine in accordance with claim 9 further comprising at least one transverse interconnecting elastic means transversely interconnecting the first and second pedal assemblies.

12. An improved skating machine in accordance with claim 9 wherein said at least one transverse interconnecting elastic means is an elongated spring.

13. An improved skating machine in accordance with claim 11 wherein said at least one transverse interconnecting elastic means is located between said transverse frame and said foot pedals.

14. An improved skating machine in accordance with claim 9 further comprising at least two spaced apart transverse interconnecting elastic means each transversely interconnecting the first and second pedal assemblies.

15. An improved skating machine in accordance with claim 14 wherein said at least two spaced apart transverse interconnecting elastic means are each an elongated spring.

16. An improved skating machine in accordance with claim 11 wherein at least one transverse interconnecting elastic means is located between said transverse frame and said foot pedals and at least one transverse interconnecting means is located between said transverse frame and said crank axle.

17. An improved skating machine in accordance with claim 9 further comprising a resilient tension means connected at one end to the crank axle and connected at its opposite end to a post which is attached to a portion of said longitudinal base frame.

18. An improved skating machine in accordance with claim 17 wherein said resilient tension means is a bungee cord.

19. An improved skating machine comprising:

a. a base frame assembly having at least a transverse base frame and a longitudinal base frame;

b. a first pedal assembly having a foot pedal adjacent one end and rotatably connected to said transverse frame;

c. a second pedal assembly having a foot pedal adjacent one end and rotatably connected to said transverse frame, the first and second pedal assemblies being side-by-side and located on opposite sides of the longitudinal frame;

d. a frame assembly which supports a resistance means; and e. a first pedal connector flexible bar and a second pedal connector flexible bar each rotatably connected at their respective outer end to a respective first and second pedal assembly and rotatably connected at their respective opposite inner end to a crank axle, a crank connected at one end to the crank axle and connected at its opposite end to said resistance means.

20. An improved skating machine in accordance with claim 19, wherein each of said pedal connector flexible bars is comprised of a first and second sleeve having a respective outer and inner end, a hollow rod having a middle area and a spring, wherein the spring which is placed in the middle of the hollow rod rests adjacent a respective inner end of the respective first and second sleeves so that the respective outer ends of the first and second sleeves become the respective first outer end and second outer end of the respective pedal connector flexible bars.

21. An improved skating machine in accordance with claim 19 further comprising at least one transverse interconnecting elastic means transversely interconnecting the first and second pedal assemblies.

22. An improved skating machine in accordance with claim 21 wherein said at least one transverse interconnecting elastic means is an elongated spring.

23. An improved skating machine in accordance with claim 21 wherein said at least one transverse interconnecting elastic means is located between said transverse frame and said foot pedals.

24. An improved skating machine in accordance with claim 19 further comprising at least two spaced apart transverse interconnecting elastic means each transversely interconnecting the first and second pedal assemblies.

25. An improved skating machine in accordance with claim 24 wherein said at least two spaced apart transverse interconnecting elastic means are each an elongated spring.

26. An improved skating machine in accordance with claim 24 wherein at least one transverse interconnecting elastic means is located between said transverse frame and said foot pedals and at least one transverse interconnecting means is located between said transverse frame and said crank axle.

27. An improved skating machine in accordance with claim 19 further comprising a resilient tension means connected at one end to the crank axle and connected at its opposite end to a post which is attached to a portion of said longitudinal base frame.

28. An improved skating machine in accordance with claim 27 wherein said resilient tension means is a bungee cord.

* * * * *